US006511068B1

(12) United States Patent
Sklansky et al.

(10) Patent No.: US 6,511,068 B1
(45) Date of Patent: Jan. 28, 2003

(54) SYSTEM AND METHOD FOR CONCURRENTLY PLAYING MULTIPLE COMMUNAL CARD POKER GAMES

(75) Inventors: David Bruce Sklansky, Las Vegas, NV (US); Bradley Berman, Minneapolis, MN (US)

(73) Assignee: Sklansky LLC, Minnetonka, MN (US)

( * ) Notice: Subject to any disclaimer, the term of this patent is extended or adjusted under 35 U.S.C. 154(b) by 0 days.

(21) Appl. No.: 09/579,919

(22) Filed: May 26, 2000

(51) Int. Cl.[7] ..... A63F 1/00
(52) U.S. Cl. ..... 273/237; 463/13
(58) Field of Search ..... 463/13; 273/292

(56) References Cited

U.S. PATENT DOCUMENTS

| | | | | | |
|---|---|---|---|---|---|
| 5,265,882 | A | | 11/1993 | Malek | |
| 5,328,189 | A | | 7/1994 | Malek | |
| 5,356,140 | A | | 10/1994 | Dabrowski et al. | |
| 5,377,993 | A | | 1/1995 | Josephs | |
| 5,382,025 | A | * | 1/1995 | Slanksy et al. | 273/292 |
| 5,486,005 | A | | 1/1996 | Neal | |
| 5,496,038 | A | | 3/1996 | Kangsanaraks | |
| 5,531,448 | A | * | 7/1996 | Moody | 273/292 |
| 5,573,249 | A | | 11/1996 | Johnson | |
| 5,577,731 | A | | 11/1996 | Jones | |
| 5,639,092 | A | | 6/1997 | Macaisa | |
| 5,657,993 | A | * | 8/1997 | Merlino et al. | 273/292 |
| 5,718,430 | A | * | 2/1998 | Aramapakul et al. | 273/191 |
| 5,732,950 | A | | 3/1998 | Moody | |
| 5,823,873 | A | | 10/1998 | Moody | |
| 6,102,402 | A | * | 8/2000 | Scott et al. | 273/292 |
| 6,132,311 | A | * | 10/2000 | Williams | 463/13 |
| 6,206,373 | B1 | * | 3/2001 | Garod | 273/292 |
| 2001/0052671 | A1 | * | 12/2001 | Stern | 273/292 |
| 2002/0008356 | A1 | * | 1/2002 | De Keller | 273/292 |

* cited by examiner

*Primary Examiner*—Jessica Harrison
(74) *Attorney, Agent, or Firm*—Crawford PLLC

(57) ABSTRACT

A system, method and program for playing multiple, communal-card poker games simultaneously. A plurality of selectable starting hands of cards are presented to a participant. Each of the selectable starting hands represents a potential subset of a resulting poker hand, and does not of itself represent a playable hand. The participant selects one of the starting hands for use in all of the concurrently-played poker games. A plurality of communal-card flops are presented to the participant. The number of communal-card flops displayed corresponds to the number of poker games to be concurrently-played. A plurality of participant resulting poker hands are derived, one for each combination of the participant's selected starting hand and the plurality of communal-card flops. A plurality of remaining resulting poker hands are also derived, one for each combination of non-selected starting hands and each of the communal-card flops. The resulting poker hands for the participant are compared to the remaining resulting poker hands on a per-poker game basis, such that the participant's resulting poker hands and the remaining resulting poker hands associated with corresponding multi-card flops are compared to each other to determine a winning poker hand for each of the concurrently-played poker games.

54 Claims, 13 Drawing Sheets

SYSTEM AND METHOD FOR CONCURRENTLY PLAYING MULTIPLE COMMUNAL CARD POKER GAMES

FIELD OF THE INVENTION

This invention relates generally to games, and more particularly to a system and method for concurrently playing a plurality of poker games utilizing starting hands and communal card flops.

BACKGROUND OF THE INVENTION

Card games such as poker have long been enjoyed by society as a means for entertainment. The popularity of casino gambling with wagering continues to increase, as does recreational gambling such as non-wagering computer game gambling. In one traditional cardroom poker game, players gather to compete against each other, by waging bets that their poker hand will have a higher poker rank than the other players' hands. The highest poker rank in each played hand is the winner of the hand, and if bets were made, the winner collects the bets made by the losing players for that hand.

However, it is often the case that players would rather place their bets against the "house," rather than against each other. A method for playing a poker game that allows bets to be wagered against the house, yet maintaining a competitive cardroom poker environment, is described in U.S. Pat. No. 5,382,025, issued to Sklansky et al. on Jan. 17, 1995. Sklansky et al. describes the problems associated with playing cardroom poker where each player is competing against his/her fellow players rather than against the house, as well as the inability for traditional poker to provide for incentive features such as bonuses associated with certain poker ranks. Sklansky et al. further describes a conventional form of live table poker known as "Hold'em," where each player at the table is dealt, face-down, a hand of two cards. After a betting round, the dealer turns face-up three communal cards known as the "flop" Bets are made, and additional cards of the flop are turned face up. Thus, each of the players uses his/her two-card face-up hand in connection with the flop to determine the resulting poker rank, and the highest poker rank identifies the winner of the round. Among other things, the Sklansky et al. patent thus describes a manner of allowing players to compete against the house rather than each other.

In the case of communal card poker games such as Hold'em, the players play their hands against the other players' hands. In other types of poker games, such as standard five-card video poker, the player is competing against a preset, threshold poker rank to determine whether or not the player's hand is a winning hand. No other "players" are, or need to be involved. In communal card poker games such as Hold'em, every hand will produce a winner to one of the players of the round, because no threshold poker rank is required. For example, in Hold'em, a player may win having the highest poker rank of Ace-high over the remaining players. This characteristic of such communal card poker games, i.e., that the poker hands are played relative to each other rather than a predetermined threshold poker rank, requires computation of a resulting hand for each player, that can be compared to other players' poker hands. The competition for highest poker rank between players holds true even where the wagering itself is against the house. This multi-player characteristic requires analysis of multiple player hands before determining which hand is the winner.

Despite the benefits and advantages provided by the Sklansky et al. U.S. Pat. No. 5,382,025 described above, the prior art does not provide a manner of increasing the game play volume for communal card games, such as Hold'em, Omaha, and other poker games utilizing partial starting hands, communal: cards, and multiple players. The ability to play an increased volume of communal card poker games in a given time period may be desirable to the player, and in the case of casino gambling, to the casino.

Accordingly, there is a need for a manner of increasing the volume of multi-player, communal card poker games that can be played in a given amount of time. It would also be beneficial to provide multiple environments to facilitate playing of these games. The present invention provides a solution to the aforementioned and other shortcomings of the prior art, while offering additional advantages over the prior art.

SUMMARY OF THE INVENTION

The present invention generally relates to a method, apparatus, and program for facilitating concurrent play of multiple communal-card poker games. The poker games are of a type utilizing starting hands. The starting hands are initially-dealt groups of cards that are shown to a participant, allowing the participant to select one of the card groups believed to be the most likely to result in winning hands when combined with a plurality of communal card "flops." The invention provides a manner in which multiple poker games utilizing such starting hands and communal card flops can be concurrently played. Multiple starting hands are dealt, and a participant selects one of the starting hands. Multiple communal card flops are dealt one for each of the concurrently-played poker games—each of which ultimately results in a separate resulting poker hand when combined with the selected starting hand. The participant's resulting poker hands are compared to other hands, i.e., other player's hands in a live table embodiment of the invention or computer-generated hands in a computer-implemented embodiment, to determine the winner of each concurrently-played poker game/round.

In accordance with one embodiment of the invention, a method for electronically facilitating concurrent play of multiple, communal-card poker games by a participant is provided. A plurality of selectable starting hands of cards are displayed on a display device, where each of the selectable starting hands represents a potential subset of a resulting poker hand. The participant selects one of the plurality of selectable starting hands via a user interface. A plurality of multi-card flops are displayed on the display device. The number of multi-card flops displayed corresponds to the number of poker games to be concurrently-played. A plurality of participant resulting poker hands are derived, one for each combination of the participant's selected starting hand and the plurality of multi-card flops. A plurality of remaining resulting poker hands are also derived, one for each combination of non-selected ones of the starting hands and the plurality of multi-card flops. The participant resulting poker hands are compared to the remaining resulting poker hands on a per-poker game basis, such that the participant resulting poker hands and the remaining resulting poker hands associated with corresponding multi-card flops are compared to determine a winning poker hand for each of the concurrently-played poker games.

In accordance with another embodiment of the invention, a method for electronically facilitating concurrent play of multiple, communal-card poker games by a participant is provided. A plurality of selectable starting hands of cards are displayed on a display device, wherein each of the selectable starting hands represents a potential subset of a resulting poker hand. The participant is allowed to select one of the plurality of selectable starting hands via a user interface. A plurality of multi-card flops are displayed on the display device, wherein each of the multi-card flops displayed corresponds to one of the concurrently-played poker games. A plurality of participant resulting poker hands are derived, one for each combination of the participant's selected starting hand and each of the multi-card flops, wherein each of the participant's resulting poker hands is derived by determining the highest poker rank available for a predetermined number of total cards associated with each combination of the participant's selected starting hand and each of the multi-card flops. Analogously, a plurality of remaining resulting poker hands are derived, one for each combination of non-selected ones of the starting hands and each of the multi-card flops, wherein each of the remaining resulting poker hands is derived by determining the highest poker rank available for the predetermined number of total cards associated with each combination of the non-selected starting hands and each of the multi-card flops. The participant's resulting poker hands are compared to the remaining resulting poker hands for each of the concurrently-played poker games, to determine whether the participant's resulting poker hands have higher poker ranks than corresponding ones of the remaining resulting poker hands for each of the concurrently-played poker games.

Another embodiment of the invention allows a plurality of poker players to concurrently play multiple communal-card poker rounds. A plurality of starting hands are presented face-up, where each starting hand includes one or more cards representing a potential portion of a resulting poker hand. Each player is required to select any one of the starting hands, and multiple players may select the same starting hand. A plurality of communal-card flops are presented face-up, where one of the communal-card flops is presented for each of the multiple poker rounds that is concurrently played. For a first concurrently-played poker round, the players' resulting poker hands are compared to one another, where each of the players' resulting poker hands is derived from the player's selected starting hand and a first communal-card flop. For a second concurrently-played poker round, the players' resulting poker hands are again compared to one another, where each of the players' resulting poker hands is derived from the player's selected starting hand and a second communal-card flop. A predetermined poker rank is used as the criterion for comparison. Additional poker rounds may also be played, where each of the players' resulting poker hands associated With a particular flop are similarly compared.

In accordance with another embodiment, a method for concurrently playing multiple communal-card poker games is provided, where a plurality of selectable starting hands of cards are presented. Each of the selectable starting hands represents a potential subset of a resulting poker hand. Game participants are allowed to select any one of the plurality of selectable starting hands. A plurality of communal-card flops are presented, where each of the presented communal-card flops corresponds to one concurrently-played communal-card poker game. Resulting poker hands are derived for each of the concurrently-played communal-card poker games for each of the participants, where each of the resulting, poker hands is derived from at least a portion of the cards associated with each selected starting hand and one of the communal-card flops. Each of the participants' resulting poker hands are compared to each other on a per-poker game basis.

Another embodiment involves a method for concurrently playing multiple poker rounds, where a plurality of starting hands are dealt. Each starting hand includes one or more cards representing a potential portion of a resulting poker hand. One of the starting hands is selected by a game participant for use in all of the multiple poker rounds. The remaining starting hands are distributed to a corresponding number of dummy hands for use in all of the multiple poker rounds. These dummy hands are not associated with an actual player, but instead represent hands that the participant must beat in order to win corresponding poker rounds. A plurality of communal card flops are also dealt, wherein each of the communal card flops includes at least one face up card. The number of communal card flops dealt corresponds to the number of multiple poker rounds being concurrently played. Participant poker ranks are determined for each of the game participant's resulting poker hands derived from cards comprising the selected starting hand and each of the plurality of the communal card flops. Similarly, remaining poker ranks are determined for each resulting dummy hand derived from cards comprising each remaining starting hand and each of the plurality of the communal card flops. For each of the multiple poker rounds concurrently played, it is then determined which of the participant's resulting poker hands and the dummy hands corresponds to a winning poker hand in accordance with a predetermined poker rank hierarchy.

In accordance with another aspect of the invention, a computer-implemented poker system for allowing a game participant to concurrently play a plurality of communal-card poker rounds is provided. A display device displays an electronic image of a plurality of starting hands and a plurality of communal-card flops. The number of the communal-card flops dealt corresponds to the number of concurrently played communal-card poker rounds, and the starting hands represent a potential portion of a resulting poker hand. A user interface is provided to allow the game participant to select one of the displayed starting hands. A computer processing system is configured to derive a plurality of participant's resulting poker hands from corresponding card groups comprising the selected starting hand and each of the plurality of communal-card flops, and to derive remaining resulting poker hands from corresponding card groups comprising each non-selected starting hand in connection with each of the plurality of communal-card flops. The computer processing system also determines relative poker ranks of the participant's resulting poker hand and the remaining resulting poker hands for each corresponding poker round.

Another aspect of the invention includes a computer-readable medium having computer-executable instructions for executing a program of instructions. The program instructions carry out various steps to allow concurrent play of multiple communal-card poker games. These steps include displaying a plurality of selectable starting hands of cards on a display device, wherein each of the selectable starting hands represents a potential subset of a resulting poker hand. The steps further include allowing the participant to select one of the plurality of selectable starting hands via a user interface. A further step displays a plurality of multi-card flops on the display device, wherein each of the multi-card flops displayed corresponds to one of a plurality of concurrently-played poker games. The program of instructions further derives a plurality of participant resulting poker hands and a plurality of remaining resulting poker hands. One participant resulting poker hand is provided for each combination of the participant's selected starting hand and the plurality of multi-card flops, and the remaining resulting poker hands involve combinations of the non-selected starting hands and each of the plurality of multi-card flops. The program instruction steps further includes comparing the participant resulting poker hands to the remaining resulting poker hands on a per-poker game basis, such that the participant resulting poker hands and the remaining resulting poker hands associated with corresponding multi-card flops are thereby compared.

Still other objects and advantages of the present invention will become readily apparent to those skilled in this art from the following detailed description. As will be realized, the invention is capable of other and different embodiments, and its details are capable of modification without departing from the scope and spirit of the invention. Accordingly, the drawing and description are to be regarded as illustrative in nature, and not as restrictive.

BRIEF DESCRIPTION OF THE DRAWINGS

The invention is described in connection with the embodiments illustrated in the following diagrams.

DETAILED DESCRIPTION OF THE ILLUSTRATED EMBODIMENTS

Figure 1:
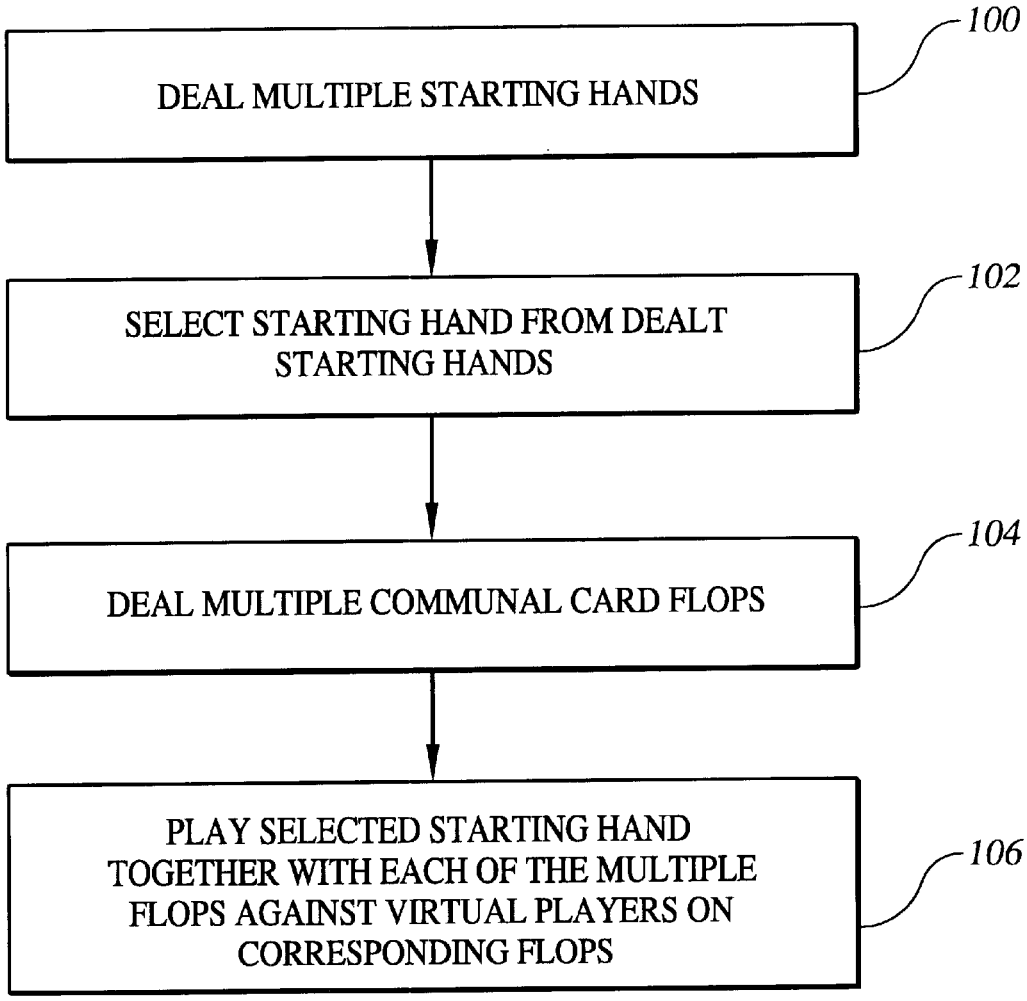
FIG. 1 is a flow diagram generally illustrating one embodiment of concurrently playing multiple hands in a communal card poker game in accordance with the present invention.

The present invention is generally directed to a manner of concurrently playing multiple poker games that use starting hands and communal card flops. Embodiments of the invention may be used in connection with live gaming table environments, or preferably in connection with computer-implemented video or other computer-implemented environments. Multiple starting hands are dealt, from which one of the starting hands is selected by a participant. A plurality of communal card flops are dealt, thereby facilitating the play of multiple, concurrent hands by the participant. Each of the actual or "virtual" players associated with each concurrently-played hand competes against the other hands for highest poker rank for each of the respective concurrent hands, yet competes against the "house" as to settling wagers for each of the concurrent hands being played.

As will become more clear in the ensuing description, the present invention may be played in a live table version, or in a single-participant environment (e.g., computer-implemented video game/machine). Single participant embodiments of the invention generally involve a single game "participant" with no other players associated with the game. The other hands dealt that are not dealt to the game participant are therefore not dealt to an actual player, as there are no other actual players in the single participant embodiments. However, for purposes of this description, the remaining hands which are not dealt to the actual game participant may be described as being dealt to "virtual players" for purposes of facilitating an understanding of the operation of the invention. It should be recognized, however, that in embodiments involving a single participant, reference to "virtual players" and the like indicates that they are not actual players, but rather represent the remaining hands that are dealt. For example, in a single participant embodiment implemented in a video game, the participant's resulting hand will be compared to the remaining resulting hands of the poker round. These remaining hands to which the participant's hand is compared may be referred to in this description as being associated with "virtual players" in some cases, simply to facilitate an understanding of a computerized version of the game by drawing this analogy to a live version of the game. Further, hands associated with remaining hands not associated with an actual player may be termed "dummy hands," which are compared against the actual participant's hand to determine whether the participant has won the poker round. Again, it should be recognized that only a single participant need actually be involved, as will become evident from the description of the various embodiments set forth herein.

It should also be recognized that, for purposes of the following description, the term "flop" is used in a broad, generic sense to refer to a number of community cards. While certain poker terminology may refer to a "flop" in a more specific manner, such as the first three community cards dealt, the description provided herein is not so limited. The term "flop" may refer to any number of community cards dealt, as will be readily apparent from a reading of the description below. For example, the description may refer to the "flop" as all of the cards (e.g., five community cards in one embodiment) that are dealt as community cards.

FIG. 1 is a flow diagram generally illustrating one embodiment of the present invention. A plurality of starting hands are dealt 100. The starting hands represent a potential portion of a resulting poker hand, and do not in and of themselves represent a playable poker hand. The number of cards dealt in connection with dealing the multiple starting hands can be any predetermined number of cards representing an incomplete portion of a resulting poker hand. For example, the number of cards associated with a particular starting hand could be one, two, three or four cards when played in connection with a poker game where the resulting poker hand includes five cards. However, the more cards dealt in connection with the starting hand, the easier it becomes for the participant(s) to select a starting hand that will produce the winning resulting hand. Therefore, in one embodiment of the invention, a two-card starting hand is implemented for each of the multiple starting hands dealt, providing an appropriate difficulty balance for subsequent selection.

The number of multiple starting hands dealt may also vary. In one embodiment, a single participant of a computer-implemented version of the invention plays against one or more other hands, also referred to as "virtual players," which creates an environment for the participant as if the participant were playing against actual other poker players at a live table. In this embodiment, the number of starting hands dealt corresponds to the total number of actual participants and virtual players. For example, a video machine or other computer-implemented embodiment of the invention may include two virtual players (i.e., two additional hands) to play against the participant. In such an example, three starting hands are dealt, one for the participant, and the two remaining hands to which the participant plays against (e.g., one for each of the "virtual players"). In other embodiments described more fully below, a predetermined number of starting hands are dealt which may be less than the total number of the participant and the virtual players, where the participant and each remaining game player (actual, virtual, etc. as the case may be) have the opportunity to select the same starting hand.

A participant of the game then selects one of the dealt starting hands as illustrated at operation 102. This starting hand becomes a potential portion of a resulting poker hand derived from the starting hand and a communal card "flop." In one embodiment of the invention, a game participant selects one of the starting hands, and the remaining starting hands are distributed to each of the remaining players, such as the virtual players in a video or computer-implemented embodiment of the invention. (In a computer-implemented embodiment, the virtual players may be represented by the remaining dealt hands.) In other embodiments, multiple players can select one of the dealt starting hands, even where multiple players select the same starting hand.

Multiple "flops" are then dealt 104. The flop is a group of community cards to which each of the players, actual or virtual, use in connection with their respective starting hands to form their resulting poker hands. In accordance with the present invention, multiple flops of communal cards are presented, thus allowing the participant to engage in multiple poker hands in parallel. For example, the starting hand selected by a participant is used in connection with each of the multiple flops dealt, in order to generate of an equal number of resulting poker hands from the selected starting hand.

The number of cards dealt in connection with a flop may be a predetermined number of cards, and may depend on the number of cards dealt for the starting hands and on the particular poker game style. For example, where two cards are dealt for each starting hand, the flop may include only three cards where the poker game is of the five card stud genre, or may include five cards where the game is a seven card game where two of the available cards are disregarded to form a five card resulting hand. Where three cards are used for each starting hand, the number of cards in the flop in the previous example would be two and four respectively. In one particular embodiment of the invention, a seven card game is played using two-card starting hands, thereby resulting in five-card communal flops.

The number of multiple flops dealt may be selected by a game participant, or alternatively may be predetermined. For example, in one embodiment, a predetermined number of three five-card flops are dealt, resulting in three concurrent poker games being played. In other particular embodiment employing computing systems such as a video poker machine or computer poker game, the participant defines the number of games to concurrently play via a user interface. In one embodiment of the invention, the user interface includes one or more manually-activated buttons resident on a video poker machine. Selection of the number of concurrent games to play is thus initiated by pressing a button corresponding to the desired number of concurrent games, pressing a particular button a number of times corresponding to the desired number of concurrent games, etc. The user interface may also be a traditional user interface to a computing system (e.g., personal computer) that facilitates play of the game, such as a graphical user interface (GUI) that displays a selectable list of the available number of concurrent games that can be played. In such a case, GUI selection tools, such as a mouse, joystick, keyboard, etc., facilitates selection of the desired number of concurrent games. Other known user interfaces may also be used within the scope and spirit of the invention, including text entry, voice activated input, touch screens, etc.

The participant's resulting hands, derived from a combination of the starting hand and each of the dealt flops, are compared head-to-head against the resulting hands of each of the remaining players, as seen at operation 106. Resulting hands for each of the remaining players (or virtual players as the case may be) are also derived from the combination of their respective starting hands and each of the dealt flops. For example, the participant's selected starting hand, in combination with a first five-card flop produces seven cards from which the best possible five-card poker rank may be derived. Similarly, the remaining players each combine their two-card starting hands with the first flop to arrive at their best possible five-card poker ranks. Each dealt flop is similarly used in connection with each player's starting hand to arrive at a plurality of poker hands for the participant and the remaining players. All resulting hands associated with each particular flop are then compared to determine the winner, by poker rank, of each concurrently played game. In this manner, the participant concurrently plays multiple poker hands against his/her opponents.

Poker rank refers to the hierarchical levels given to certain predefined poker hands. Poker hands having lesser statistical frequencies are ranked higher than those that are statistically easier to obtain. Conventional poker rank, from highest to lowest, is set forth in the following table:

TABLE 1

Poker Rank

| Hand | Example |
|---|---|
| Royal Flush | A, K, Q, J, 10 (suited) |
| Straight Flush | 3, 4, 5, 6, 7 (suited) |
| Four Of A Kind | 8, 8, 8, 8, 5 |
| Full House | 10, 10, 10, J, J |
| Flush | 3, 6, 8, J, Q (suited) |
| Straight | 5, 6, 7, 8, 9 (unsuited) |
| Three Of A Kind | Q, Q, Q, 2, 3 (unsuited) |
| Two Pair | A, A, J, J, 10 (unsuited) |
| One Pair | Q, Q, 4, 5, 9 (unsuited) |
| High Card In Hand | A, Q, 4, 5, 8 (unsuited) |

In one embodiment, a poker rank tie between the participant and any one or more of the virtual players results in a "win" condition for the participant. Alternatively, the participant may be required to win outright, resulting in a "push" or even a "loss" to the participant in the event of a poker rank tie.

The resulting hands may be derived from all, or a subset of, the combination of the player's starting hand and each of the flops. For example, a two-card starting hand and a five-card flop produces seven cards from which a subset, i.e. the best possible five-card poker hand, may be derived. Alternatively, a two-card starting hand and a three-card flop produces five cards from which the poker rank is directly determined.

Figure 2:
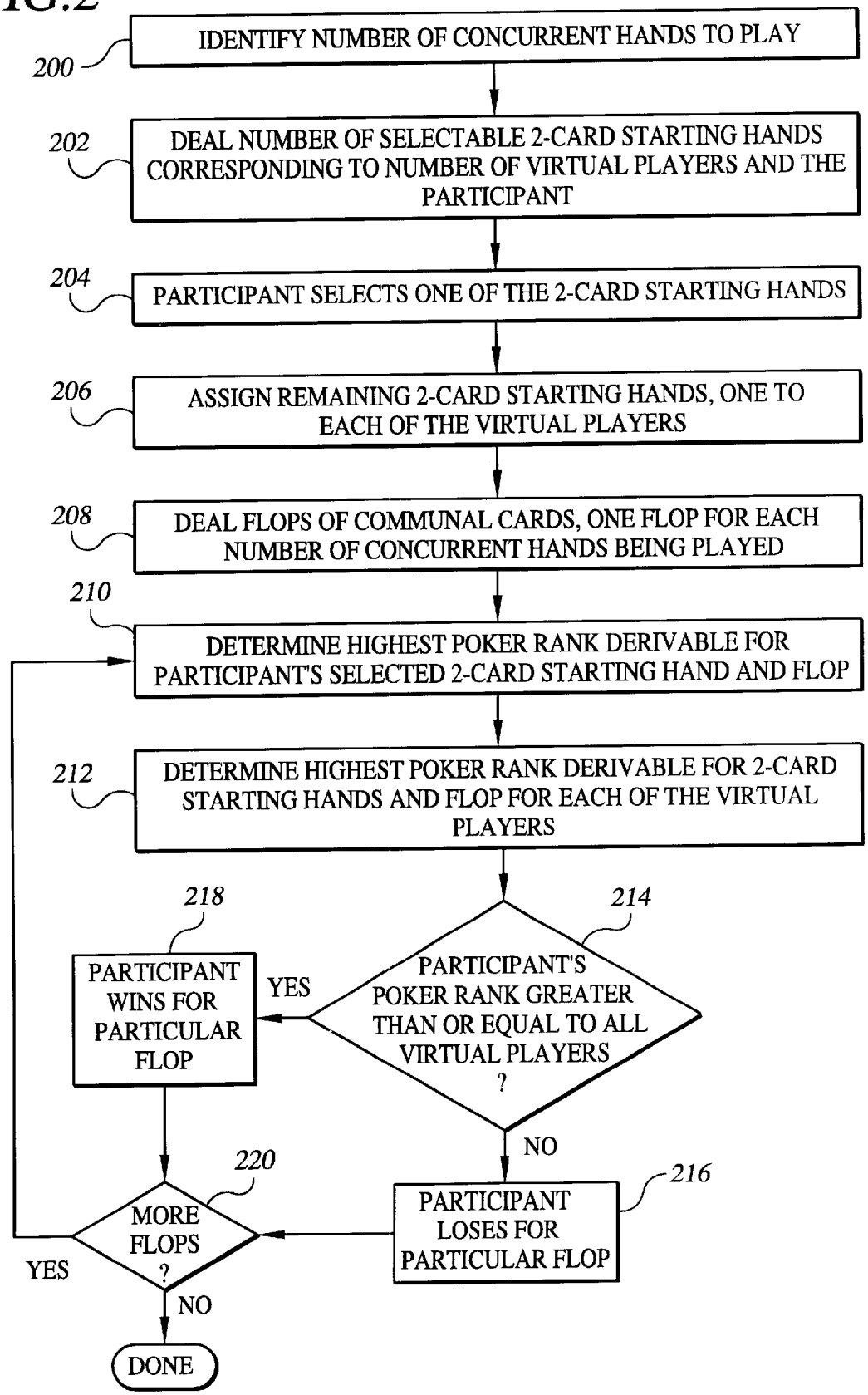
FIG. 2 is a flow diagram illustrating a particular computer-implemented embodiment of the invention.

FIG. 2 is a more detailed flow diagram of a particular computer-implemented embodiment of the invention. In this embodiment, video poker machine or other computing device allows an individual poker game participant to concurrently play multiple poker hands of the type described. The number of concurrent hands to play is identified 200. In one embodiment, the number of concurrent hands played is determined in advance, and is essentially preset to a particular number of concurrent hands. For example, a video poker machine in accordance with the present invention may preset the number of concurrent hands played to three, or five, etc. Each time the participant indicates that playing concurrent hands is desired, this predetermined number of hands will be presented to the participant. In another embodiment, the participant may select the number of concurrent hands to play, such as via a user interface. In this manner, the participant can concurrently play as many hands as desired, up to a maximum limit.

A number of selectable two-card starting hands are then dealt, as indicated at operation 202. In this embodiment, the number of starting hands dealt corresponds to the total number of players of the game, which includes the participant and the remaining "virtual players." For example, where the computer-implemented game is configured for four players, three virtual players are provided along with the participant to constitute the four player configuration. Four two-card starting hands are dealt in such a four player configuration. The participant selects 204 one of the two-card starting hands, and each the remaining two-card starting hands are respectively assigned 206 to the remaining virtual players.

When each of the participant and virtual players select or are assigned their respective starting hands, a plurality of communal card flops are dealt, as illustrated at operation 208. One flop is dealt for each of the number of concurrent hands being played. For example, where the number of concurrent hands to play was identified at operation 200 to be three (either via predetermined configuration or user selection), three flops of communal cards are dealt at operation 208. Concurrent hands are then played using these multiple flops.

Referencing the first of the multiple flops, the highest poker rank that can be derived from a combination of the two-card starting hand and the first flop is determined for the participant at operation 210. Similarly, the highest poker rank that can be derived from a combination of the first flop and each of the virtual player's respective two-card starting hands is determined at operation 212. It is then determined 214 whether the participant's poker rank is greater than or equal to all of the virtual players' derived poker ranks for that flop. If not, the participant loses the hand for that particular flop as depicted at block 216. Otherwise, if the participant's poker rank for that flop is greater than or equal to all of the virtual players' derived poker ranks for that flop, the participant is deemed the winner of that hand, as seen at block 218. In either case, it is determined 220 whether there are more flops to consider. Where more of the multiple flops are yet to be considered, the participant's and virtual players' hands are again determined 210, 212 for the next flop, and again compared to determine whether the participant's hand for that flop is greater than or equal to all of the virtual players' flops. This continues until all of the multiple flops have been considered. It should be recognized that the flow diagram of FIG. 2 is depicted in a serial format for illustrative purposes. This represents one embodiment of the invention, where flops may be revealed and analyzed one at a time. However, processing of the multiple flops can be performed in parallel, and in one embodiment of the invention, all of the multiple flops are revealed and analyzed at once.

FIGS. 3–7 illustrate an operative example of a multi-flop poker game in accordance with one embodiment of the present invention. For purposes of FIGS. 3–7, like reference numbers represent corresponding elements throughout. The multi-play poker game embodiment includes an initial face-up deal of three starting hands, identified as hand-1 300, hand-2 302 and hand-3 304. As illustrated, different numbers of flops may be dealt. In the illustrated embodiment, each starting hand consists of two cards. The starting hands do not represent a complete hand in which a poker rank is determined, but rather represent a portion of a resulting hand to which a poker rank is determined. Generally, when the game is played in a gambling environment, a bet is placed before the starting hands are dealt. In the example above, hand-1 300 includes the A-hearts and Q-hearts, hand-2 302 includes the 8-clubs and 4-spades, and hand-3 304 includes the A-spades and K-clubs. The remaining cards are initially face-down, and are arranged in multiple "flops," of communal cards. In this example, each of the flops, flop-1 310, flop-2 312 and flop-3 314, are five card flops. Preferably, the five cards associated with each of the flops is associated with a separate 52-card deck of playing cards, which is described in greater detail below.

Figure 3:
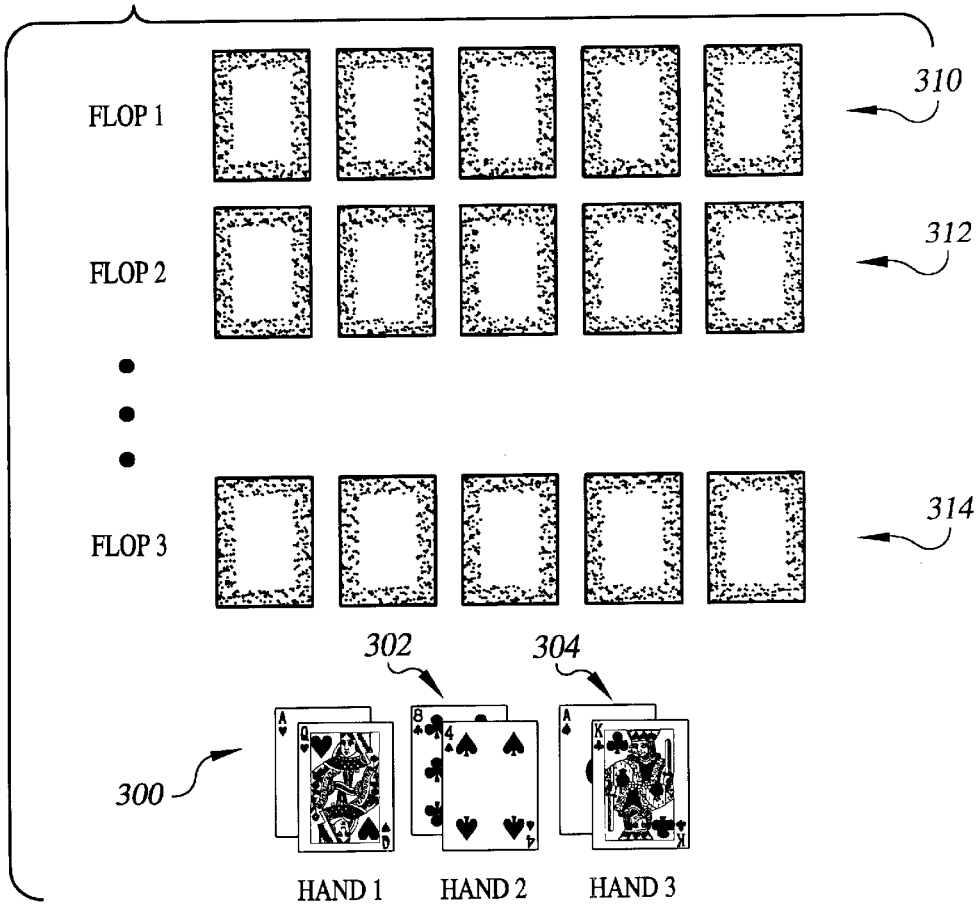
FIGS. 3–7 illustrate an operative example of a multi-flop poker game in accordance with one embodiment of the present invention.

The player selects one of the three two-card starting hands 300, 302, 304. This presents players with the opportunity to make an educated guess as to which of these multiple "partial hands" will most likely result in a winning hand when combined with a five-card flop. As shown in FIG. 3, there are multiple flops (flop-1 310, flop-2 312, flop-3 314), allowing multiple games to be played concurrently. The two-card starting hand selected by the player will be used to form a poker hand with flop-1 310, and will also be used to form poker hands with flops 312 and, 314. Analogously, the two starting hands that were not selected by the player are also used to form poker hands with these flops 310, 312, 314. In one embodiment, the remaining players/virtual players may select any one of the starting hands, and in another embodiment the starting hands that were not selected by the player are automatically distributed to the remaining players/virtual players. The player's selected starting hand, in combination with each flop, competes against the two unselected starting hands when combined with each flop. This is illustrated for one of the three flops in the example of FIG. 4.

Figure 4:
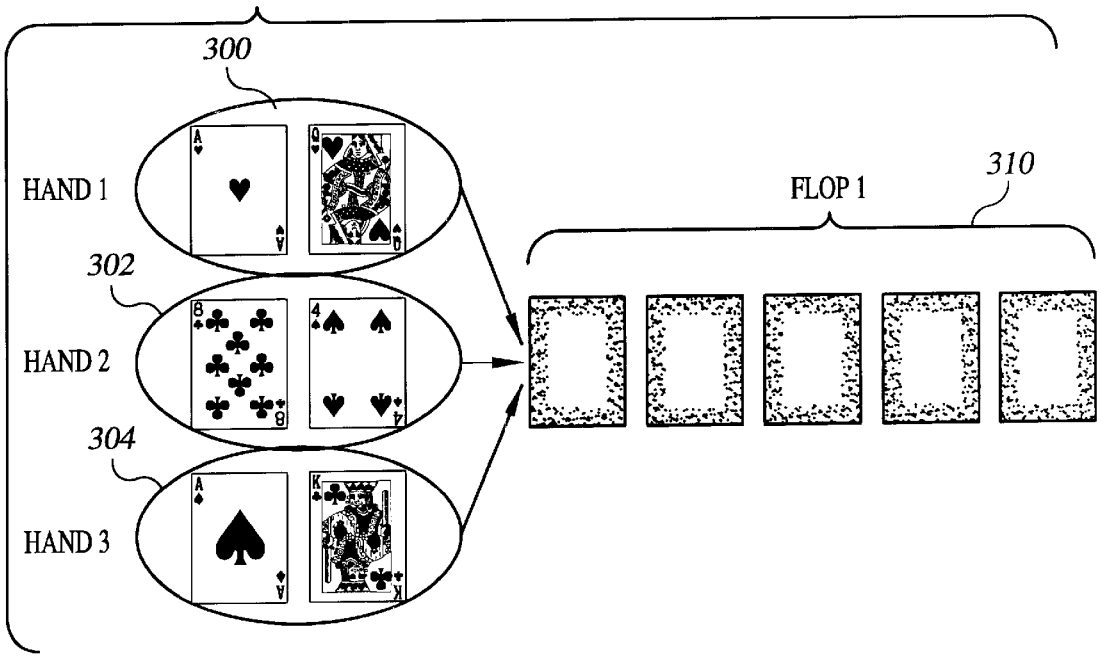

As shown in FIG. 4, each of the two-card starting hands 300, 302, 304 will be used with the common flop, which is flop-1 310 in this example. The best five cards in each hand/flop combination are used to determine which of the resulting hands is the winning hand. This is illustrated in FIG. 5.

Figure 5:
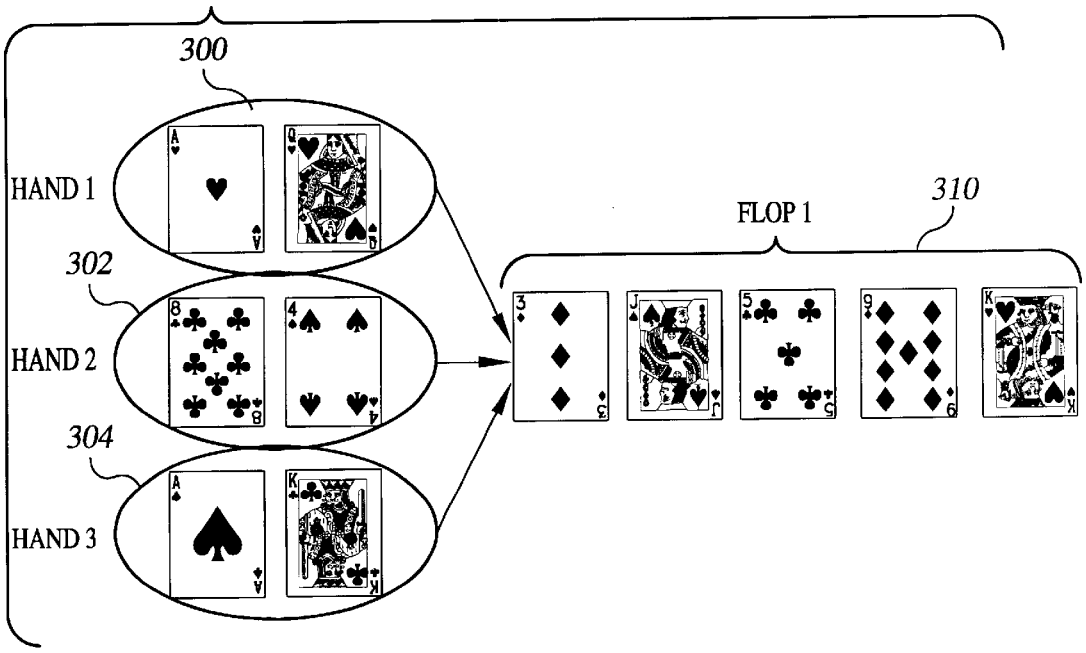
Figure 6:
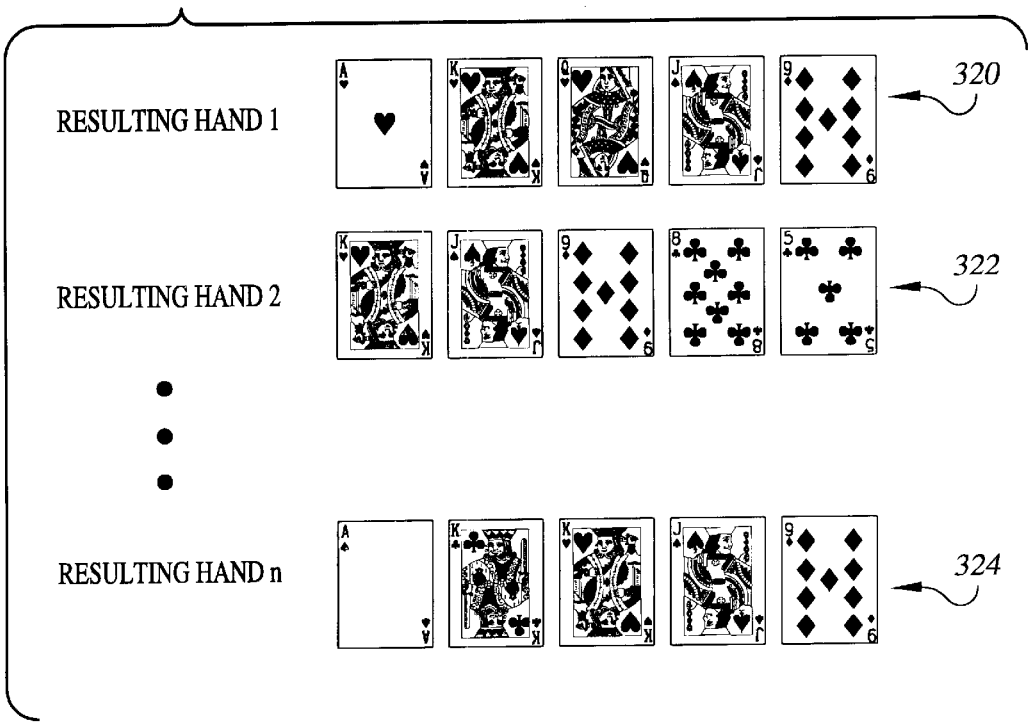

Once the player has selected one of the three starting hands, the flop is exposed as shown in FIG. 5. Each of the three starting hands uses the flop 310 to produce the best 5-card poker hand possible, while disregarding the remaining two cards regardless of whether the disregarded cards are part of the two-card hand or the flop. In other words, this embodiment allows zero, one, or both of the starting hand cards to ultimately be used in the resulting hand. The results for the present example are illustrated in FIG. 6.

If the player had chosen hand-3 304 from the three available two-card starting hands dealt, the player would win because the resulting hand-3 324 has a pair of Kings (K-clubs, K-hearts). A pair of Kings has a higher poker rank than either the resulting hand-1 320 or the resulting hand-2 322, which have only Ace-high and King-high respectively. As can be seen, each resulting poker hand is played against the other resulting poker hands derived in part from the other starting hands that the player chose not to select. Therefore, each time a player is presented with the initial deal of three two-card starting hands, there will be a winning hand—the player just has to select the correct one, which may be difficult because the five-card flop is initially face-down.

Figure 7:
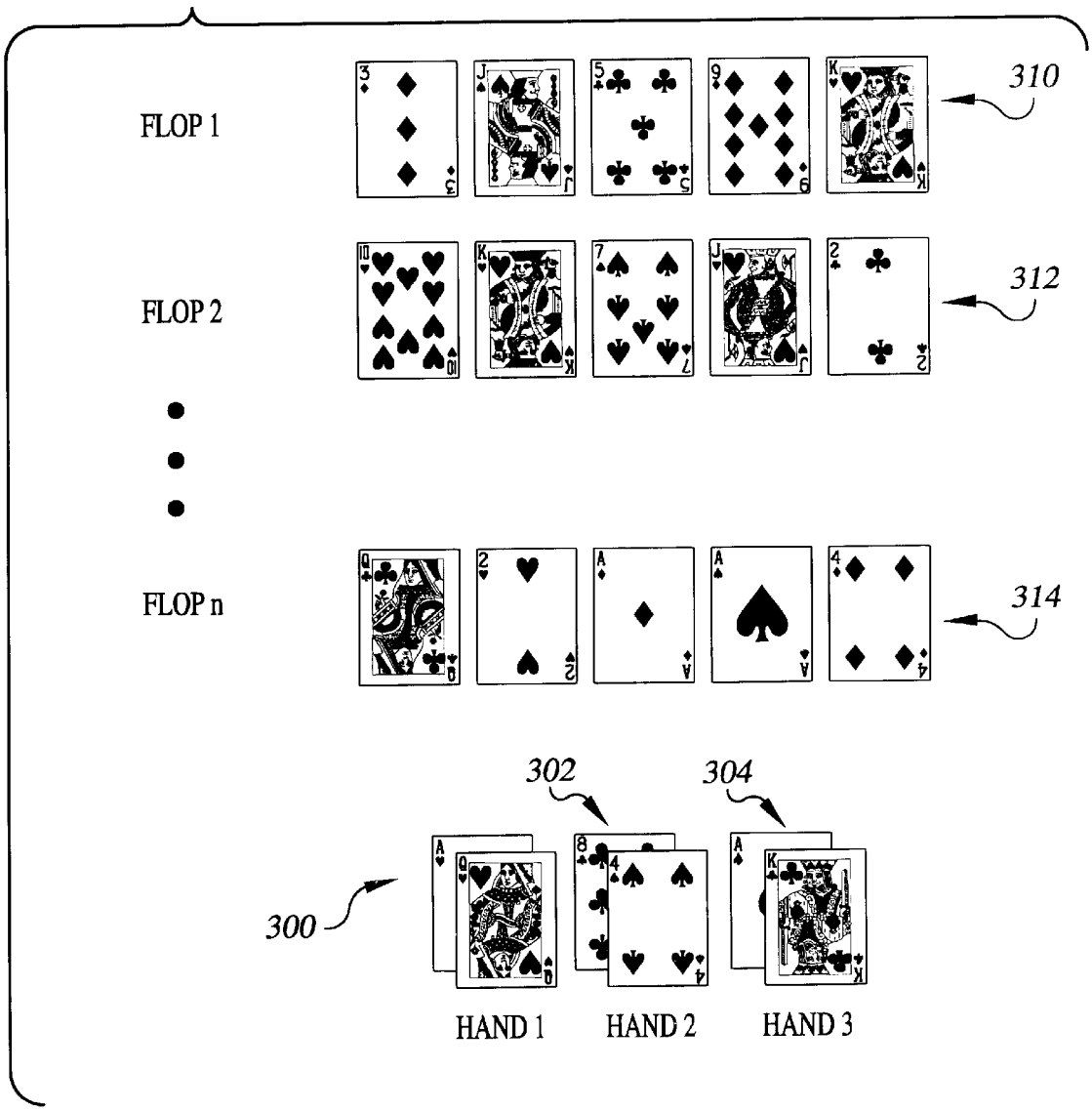

In accordance with the present invention, multiple flops are dealt to allow multiple games to be simultaneously. This is described in connection with FIG. 7. In FIG. 7, each of the numerous flops 310, 312 through 314 has been turned face-up (e.g., after the player has selected one of the two-card starting hands), thereby allowing the player to play the selected starting hand against the remaining two starting hands in each of the multiple flops. For example, if the player selected starting hand-1 300, the player would lose against hand-3 304 in flop-1 310 as was illustrated in FIG. 6. However, the player would win over starting hand-2 302 and starting hand-3 304 for flop-2 312 because starting hand-1 300 combined with flop-2 312 results in a Royal Flush (A, K, Q, J, 10 of hearts; disregarding 7-spades and 2-clubs). The player would also win over starting hand-2 302 and starting hand-3 304 for flop-n 314 because starting hand-1 300 combined with flop-n 314 results in a full house, aces over queens, which beats the hand-2/flop-n combination of two pair (Aces and fours) and the hand-3/flop-n combination of three Aces.

Therefore, once the player has selected one of the three two-card starting hands, the player uses that hand for each of the different multiple flops. The player plays against the other two starting hands, which also use the same cards in connection with each of the different multiple flops. Bonus points may be awarded for certain poker ranks, such as for a straight flush or royal flush.

It should be recognized that the present invention is also applicable to different starting hand variations. In the aforementioned embodiment, a number of cards are dealt as the selectable starting hands, and zero, one or more of the cards associated with that starting hand may be used to formulate the resulting hand. The invention also applies to other variations. For example, the starting hands may include a number of cards of which a predetermined number "must" be used to formulate the resulting hand. This may apply in the case where the participant selects one of the starting hands, or where the starting hands are actually dealt to each player. For example, one popular poker game is "Omaha," where each player is dealt four cards, and the resulting hand is formulated from exactly two of the four cards in the starting hand and three from the board. One embodiment of the present invention requires the participant to use one or more of the cards in the starting hand in connection with a predetermined number (or all) of the cards associated with each flop to formulate the resulting hands.

Figure 8:
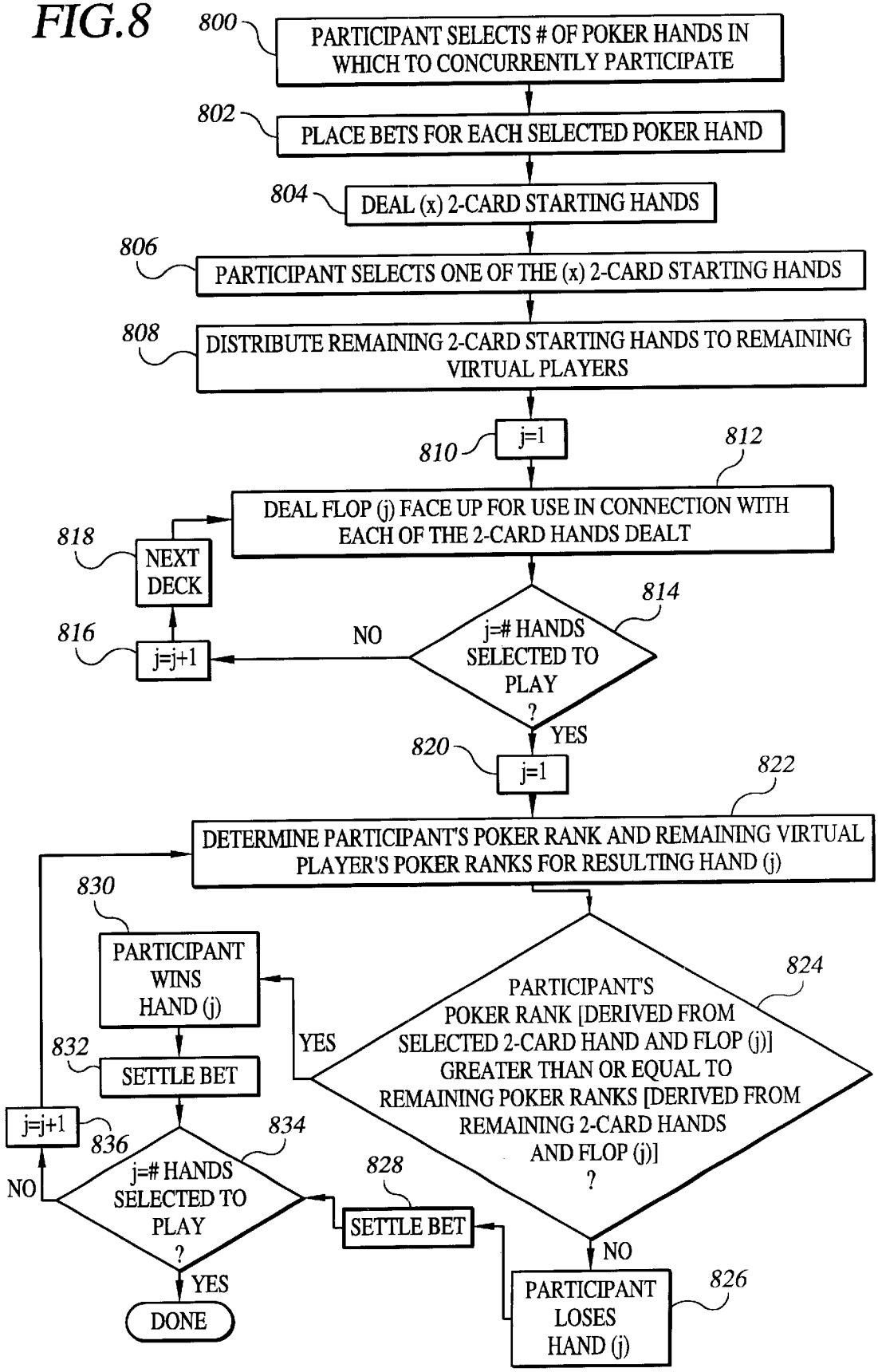
FIG. 8 is a flow diagram illustrating another particular computer-implemented embodiment of the invention.

FIG. 8 is a flow diagram of another particular computer-implemented embodiment of the invention. This embodiment may be used in connection with a video poker machine or other computer-implemented embodiment where one player/participant operates the video poker machine or other computer-implemented device, and plays against virtual players to determine whether the participant beats the "house."

The participant selects 800 a number of poker hands in which to concurrently participate. As previously described, this selection may be made via a user interface by the participant. Alternatively, the number of poker hands available for concurrent play may be preset as a configuration parameter, thus disallowing participant selection thereof. Bets are placed for each of the multiple poker hands identified for concurrent play, as seen at operation 802. A number (x) of two-card starting hands are dealt 804, where, in this embodiment, (x) represents the number of players competing in the round. For example, where the system is configured for three virtual players, (x) equals four (three virtual players plus the participant). In this embodiment, one of the starting hands will be associated with each of the virtual players and the participant, as no common selection of any particular starting hand is allowed. In other embodiments of the invention, more than one participant/virtual player may select the same starting hand.

The participant selects one of the (x) starting hands as shown at operation 806. The remaining starting hands are distributed to the remaining virtual players as shown at operation 808. This distribution may be in accordance with a predetermined distribution algorithm. For example, the first available starting hand may be configured to always be distributed to the virtual player immediately clockwise with respect to the participant, the second available starting hand always distributed to the next virtual player in a clockwise fashion, etc. Alternatively, the non-selected starting hands may be distributed randomly to the virtual players. In any event, each of the virtual players becomes associated with one of the remaining, non-selected starting hands.

A number of multiple flops corresponding to the number of hands selected for concurrent play are then dealt. This is represented, for purposes of illustration, as a loop in the flow diagram of FIG. 8. It should be recognized that the particular looping representation is not necessarily the procedure for which such multiple flops are presented, but instead provides a graphical illustration of how dealing a number of multiple flops corresponds to the number of concurrent hands that are to be played. This representation includes setting a variable j equal to 1 as shown at block 810. Flop(j), which in this instance will be a first flop identified as flop(1), is dealt 812 for ultimate use in connection with each of the two-card starting hands. If the number of poker hands identified for concurrent play were equal to (1) as identified at decision operation 814, no further flops would be dealt. However, the invention is directed to a multiple flop poker game, and where j=1, j does not equal the number of hands selected for concurrent play. Thus, the variable j is incremented as illustrated at operation 816, which ultimately allows another flops (j), which would then be a second flop identified as flop(2), to be dealt as indicated again at operation 812.

Figure 9:
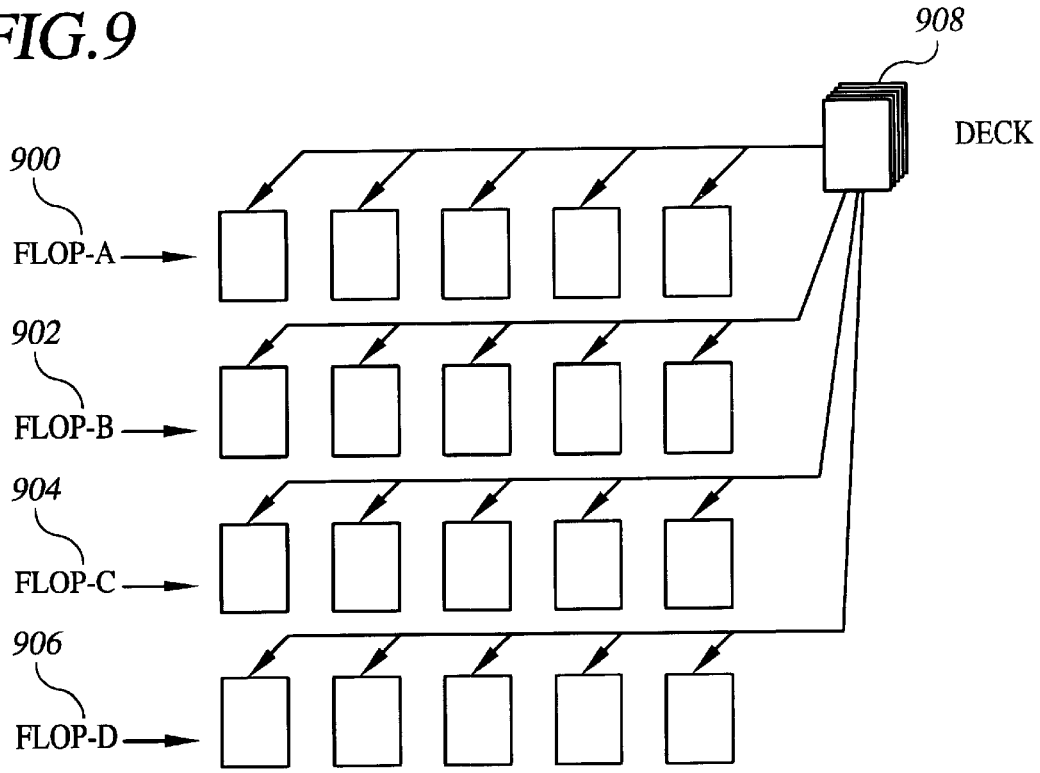
FIGS. 9–10 illustrate various embodiments for supplying multiple flops for communal card poker games in accordance with the invention.
Figure 10:
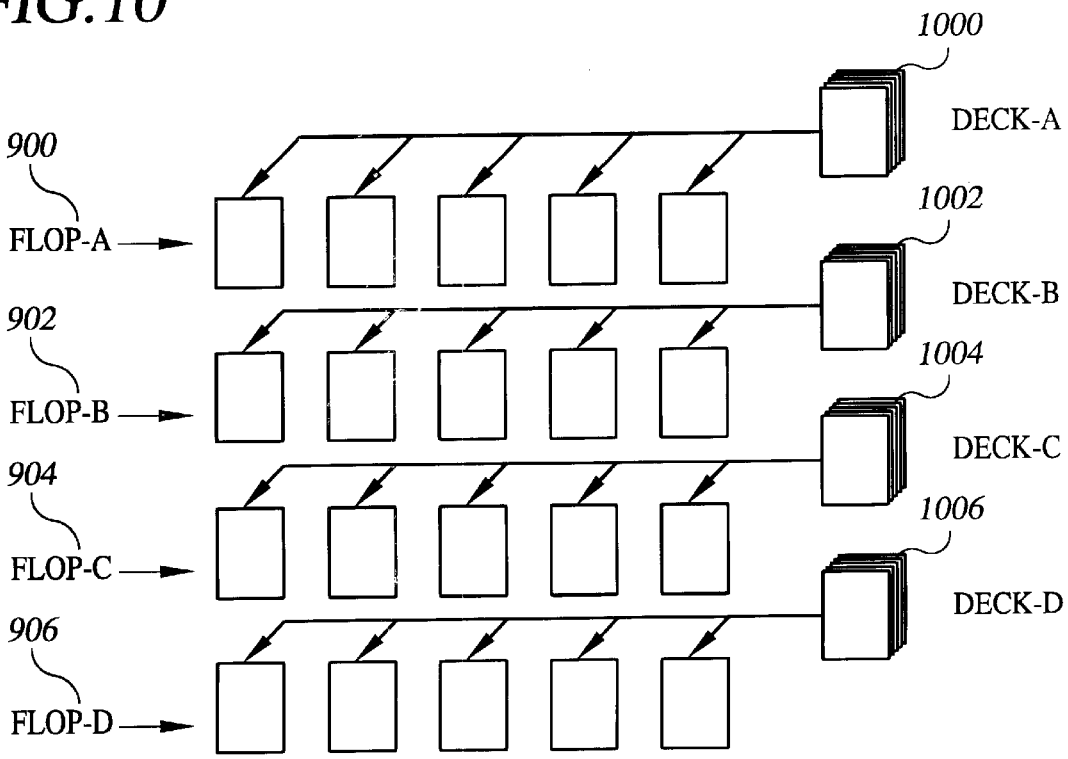

In the illustrated embodiment, each of the flops dealt are associated with a separate deck of standard poker playing cards or "virtual" cards. This essentially allows an unlimited number of multiple flops to be dealt, and consequently, an unlimited number of multiple hands to be concurrently played by the participant (without consideration to practical limitations of display capabilities of the video or computing devices, and/or other practical limitations). Alternatively, a single deck may be used to supply each of the flops. This, however, has a computable maximum number of flops that can be generated from a single deck. This is described more fully in connection with FIGS. 9 and 10. FIG. 9 illustrates an example where four five-card flops, flop-A 900, flop-B 902, flop-C 904 and flop-D 906 are to be dealt using a single deck 908. Because the deck was used to deal the starting hands, the 52-card deck will be reduced in number of cards by the number of cards dealt to the starting hands. For example, where three two-card starting hands were dealt, the deck 908 will be left with forty-six cards. With these remaining forty-six cards, a maximum of nine five-card flops can be dealt, which therefore limits the number of hands for concurrent play to nine. Use of a common deck 908 also prevents any card from being used in more than one flop. For example, the A-spades could only be associated with one of the flops 900, 902, 904, 906, since there is only one A-spades in a deck of cards. Alternatively, multiple decks may be used, and in the particular embodiment of FIG. 10, individual decks of cards is used for each of the different flops 900, 902, 904, 906. Deck-A 1000, deck-B 1002, deck-C 1004 and deck-D 1006 are used to supply flops 900, 902, 904 and 906 respectively. Each of the decks will have the starting hand cards removed, to eliminate duplicate cards within any resulting hand. Using separate decks for each of the flops allows like cards to be associated with more than one flop. For example, where separate decks furnish cards for each of the flops, the A-spades could be part of the resulting hands formed from any one or more of the flops 900, 902, 904, 906. It should be recognized that reference to a deck of cards may be either an actual deck of standard playing cards, or a virtual deck of cards which is a computerized deck of logical/virtual cards. For example, a "virtual deck" of cards would be an electronic recognition of each of the cards in a standard 52-card deck.

Returning now to FIG. 8, operation 818 may be used in connection with the dealing of flops(j). Operation 818 represents that a different deck of cards is used in connection with each deal of a flop, such as was described in the embodiment of FIG. 10. Using this approach, flops(j) is dealt 812 for ultimate use in connection with each of the two-card starting hands, and where the number of poker hands identified for concurrent play is determined 814 to be unequal to the number of hands selected for concurrent play, the variable j is incremented 816, and another deck is used to furnish the next flop as indicated at block 818. Therefore, in the illustrated embodiment of FIG. 8, each flops(j) dealt via operation 812 is dealt using a separate deck.

When all of the flops have been dealt as determined at decision operation 814, the starting hands and flops for each of the players are used to form corresponding resulting hands that can be compared against one another to determine which resulting hands have the highest poker rank. Again this is represented, for purposes of illustration, as a loop in the flow diagram of FIG. 8. It should be recognized that the particular looping representation is not necessarily the procedure for which the resulting hands are analyzed, but instead provides a graphical illustration of how each of the concurrently-played hands are determined and compared to determine the winner of each concurrently-played hand.

For purposes of illustration, a variable such as j is set 820 to one, and the participant's and virtual players' poker ranks are determined 822 for resulting hands(j). The first resulting hands(1) therefore includes a resulting hand for the participant, as well resulting hands for each of the virtual players. In the present example, resulting hands are derived from the best five cards of the respective starting hands and one of the flops. Where a five-card flop is used, five of the seven total cards that arrive at the best possible poker rank are used as a resulting hand. At decision operation 824, it is determined whether the participant's poker rank is greater than or equal to the poker ranks of the remaining virtual players' resulting hands. The participant's poker rank is derived from the participant's starting hand and flop(1), and the virtual players' poker ranks are derived from their respective starting hands and flop(1). If the participant's resulting poker rank is not greater than or equal to the poker ranks of the virtual players' the participant loses hand(1) as shown at block 826, and bets for that hand are settled 828. On the other hand, if the participant's resulting poker rank is greater than or equal to the virtual players' poker ranks, the participant wins hand(1) as shown at block 830, and bets for that hand are settled 832. It is determined 834 whether j equals the number of hands selected for concurrent play. If not, j is incremented 836 (e.g., from 1 to 2), and the participant's and virtual players' poker ranks for the next hand (e.g., hand(2) corresponding to flop(2)) are again determined 822. This continues until resulting hands have been determined and compared for each of the dealt flops, thereby analyzing each of the number of poker hands concurrently played. This looping representation is depicted as a serial operation for purposes of illustration, and represents one embodiment of the invention where flops are analyzed serially. However, processing of the multiple flops can be performed in parallel, and in one embodiment of the invention, all of the multiple flops are revealed and analyzed at once.

Figure 11:
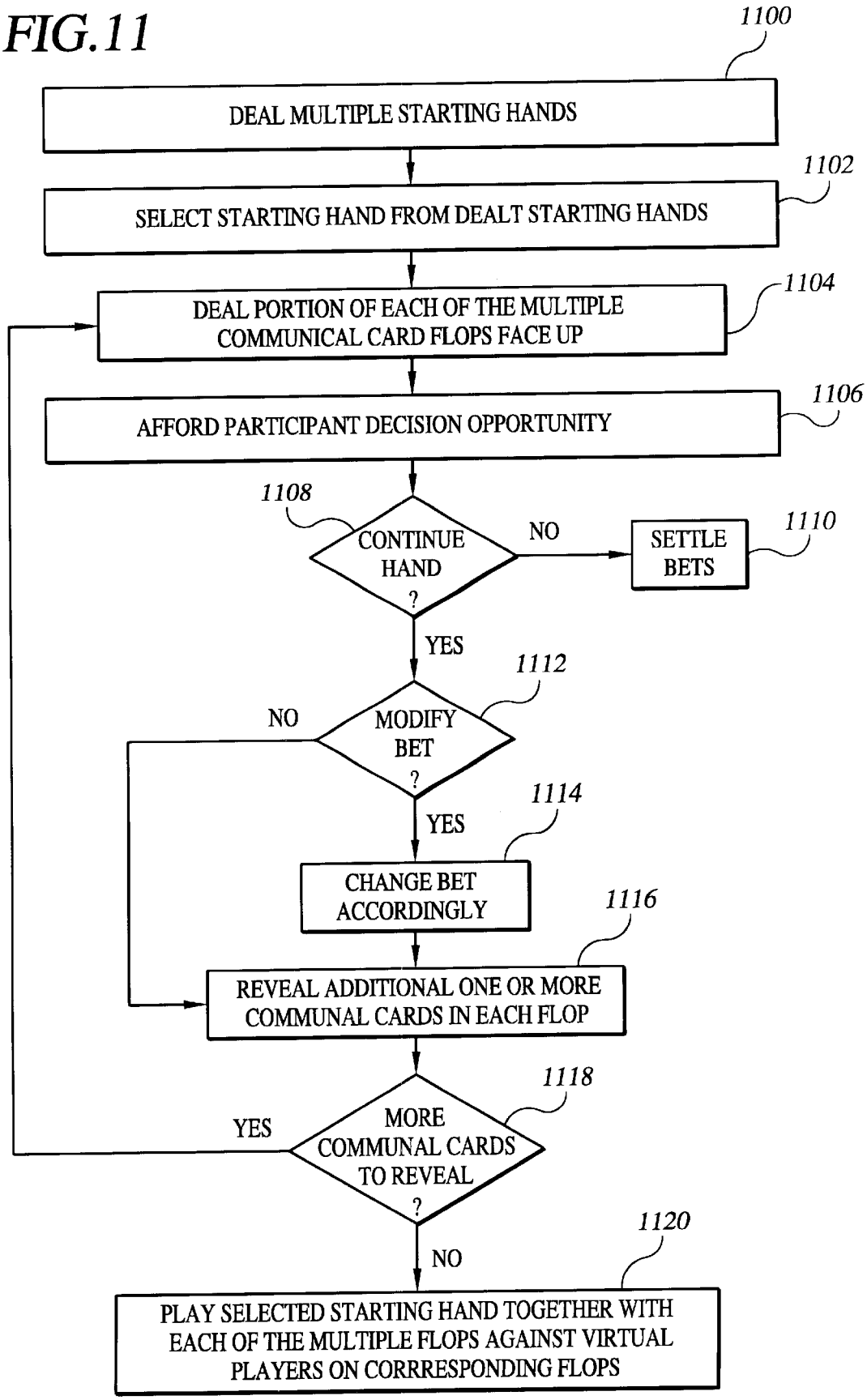
FIG. 11 is a flow diagram illustrating an embodiment of the multi-flop poker game of present invention in which decision opportunities are afforded to the participant during play of a multi-flop poker round.

FIG. 11 is a flow diagram illustrating another embodiment of the multi-flop poker game of present invention. A plurality of starting hands are dealt 1100. Again, the starting hands represent a potential portion of a resulting poker hand, and do not in and of themselves represent a playable poker hand. The number of multiple starting hands may vary, and in one particular embodiment three virtual players and one actual participant play, resulting in a four starting hand game.

A participant of the game then selects one of the dealt starting hands as illustrated at operation 1102. This starting hand becomes a potential portion of a resulting poker hand derived from the starting hand and the communal card flops. In one embodiment of the invention, a game participant selects one of the starting hands, and the remaining starting hands are distributed to each of the remaining players, such as the virtual players in a video or computer-implemented embodiment of the invention. In other embodiments, multiple players can select one of the dealt starting hands, even where multiple players select the same starting hand.

Multiple flops are then dealt 1104, but not all of the communal cards associated with each flop are revealed. Rather, a predetermined portion of each of the cards associated with each flop are left face down, so as not to allow the participant(s) to fully determine the resulting hand. For example, in one embodiment, multiple five-card flops are dealt, but only three communal cards in each of the multiple flops are dealt face up. The remaining two communal cards in each flop are left face down. This affords the participant(s) an opportunity to make a decision as to how the hand and/or the betting will proceed, as illustrated at operation 1106. For example, after the first portion of communal cards associated with each dealt flop have been revealed as face-up communal cards, the participant(s) may be afforded an opportunity to "fold" the hand and forfeit a predetermined portion of their initial bet. This predetermined portion may be any desired portion, such as, one-half of the original bet, thereby allowing the participant to recover one-half of the original bet upon folding. In this instance, it is determined whether the participant has folded, as illustrated at decision operation 1108 where it is determined whether the hand is to be continued. If not, the bets are settled 1110, such as by forfeiting one-half of the participant's bet and returning one-half of the bet to the participant.

In the case where an opportunity to fold is afforded to the participant, and the participant decides to continue the hand, it is determined whether the participant(s) want to modify the bet as illustrated at decision operation 1112. In this example, the participant(s) are afforded the opportunity to increase or otherwise modify the bet after the initial portion of the flops have been revealed, such as doubling the bet, tripling the bet, or increasing the bet by a player-determined amount. If the participant decides to do so, the bet is changed 1114 by the participant, and play of the hand continues to operation 1116 where one or more additional cards of each flop are turned face up. If all communal cards have been revealed by this time as determined at decision operation 1118, each of the participant's resulting hands, derived from a combination of the starting hand and each of the dealt flops, are compared head-to-head against the resulting hands of each of the remaining players, as seen at operation 1120. Resulting hands for each of the remaining players (or virtual players as the case may be) are also derived from the combination of their respective starting hands and each of the dealt flops. As previously described, each dealt flop is similarly used in connection with each player's starting hand to arrive at a plurality of poker hands for the participant and the remaining players. All resulting hands associated with each particular flop are then compared to determine the winner, by poker rank, of each concurrently played game.

If not all of the communal cards have been revealed as determined at decision operation 1118 (i.e., less than all of the remaining communal cards of each flop have been revealed), an additional portion of each of the multiple flops are again dealt face up at operation 1104, and the process continues until all communal cards associated with the flops have been revealed—allowing the participant to make decisions along the way. In one particular embodiment, three communal cards of each five-card flop are initially revealed, the participant makes a decision whether to fold or increase the bet, and the remaining two communal cards are then turned face up. The participant's hand will be folded, or the bets will be settled according to the increased bets, depending on the decisions made by the participant during play of the hand.

Figure 12:
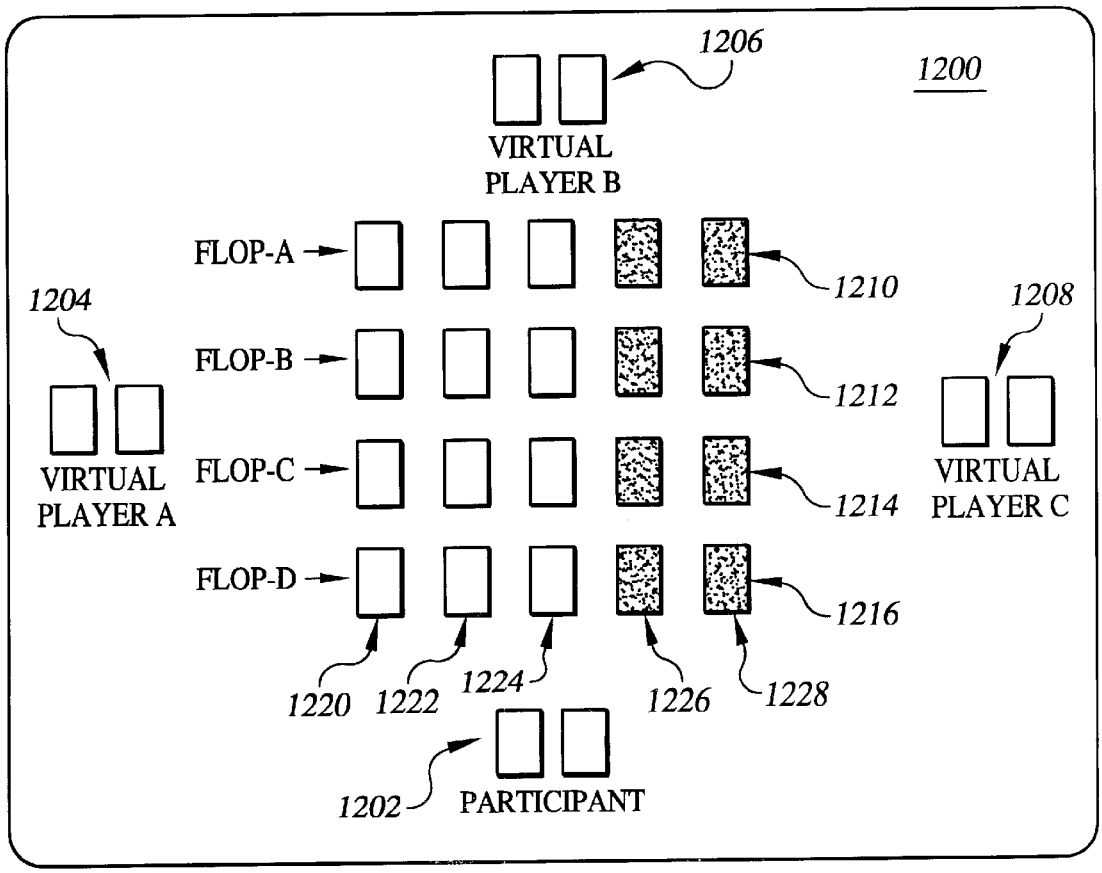
FIG. 12 depicts an example poker round for an embodiment of the multi-flop poker game in which decision opportunities are afforded to the participant during play of a multi-flop poker round.

FIG. 12 depicts a working example of the embodiment described in connection with the flow diagram of FIG. 11. In this example, the game is displayed on a display screen 1200. This example illustrates that four starting hands 1202, 1204, 1206, 1208 were dealt, and the participant selected starting hand 1202. This embodiment utilizes four flops of communal cards, labeled flop-A 1210, flop-B 1212, flop-C 1214 and flop-D 1216. The state of the example hand of FIG. 12 corresponds to the flow diagram of FIG. 11 through operation 1106, as the participant is in position to make a decision regarding the remaining play or wager amounts for that hand. Each flop 1210, 1212, 1214, 1216 includes three face up cards (illustrated in columns 1220, 1222, 1224), and two cards remaining face down (illustrated in columns 1226, 1228). The participant determines makes the appropriate decisions, such as whether to fold or whether to increase the bet. The decision made by the participant is recognized by the system via a user interface in the case of a computer-implemented embodiment, or through traditional actions in a live table version. When the decisions have been made, the remaining communal cards (i.e., the communal cards in each flow illustrated in columns 1226 and 1228) are turned face up, thereby allowing the resulting hands to be determined, and the winners of each flop to be established. It should be recognized that columns 1220, 1222, 1224, 1226, 1228 are arranged in columns to facilitate the operative description provided herein, and need not actually be physically arranged in such a manner.

The present invention may be implemented in video poker versions. An electronic video poker device of the general type suitable for use in the practice of the game according to the present invention is generally illustrated in FIG. 13.

Figure 13:
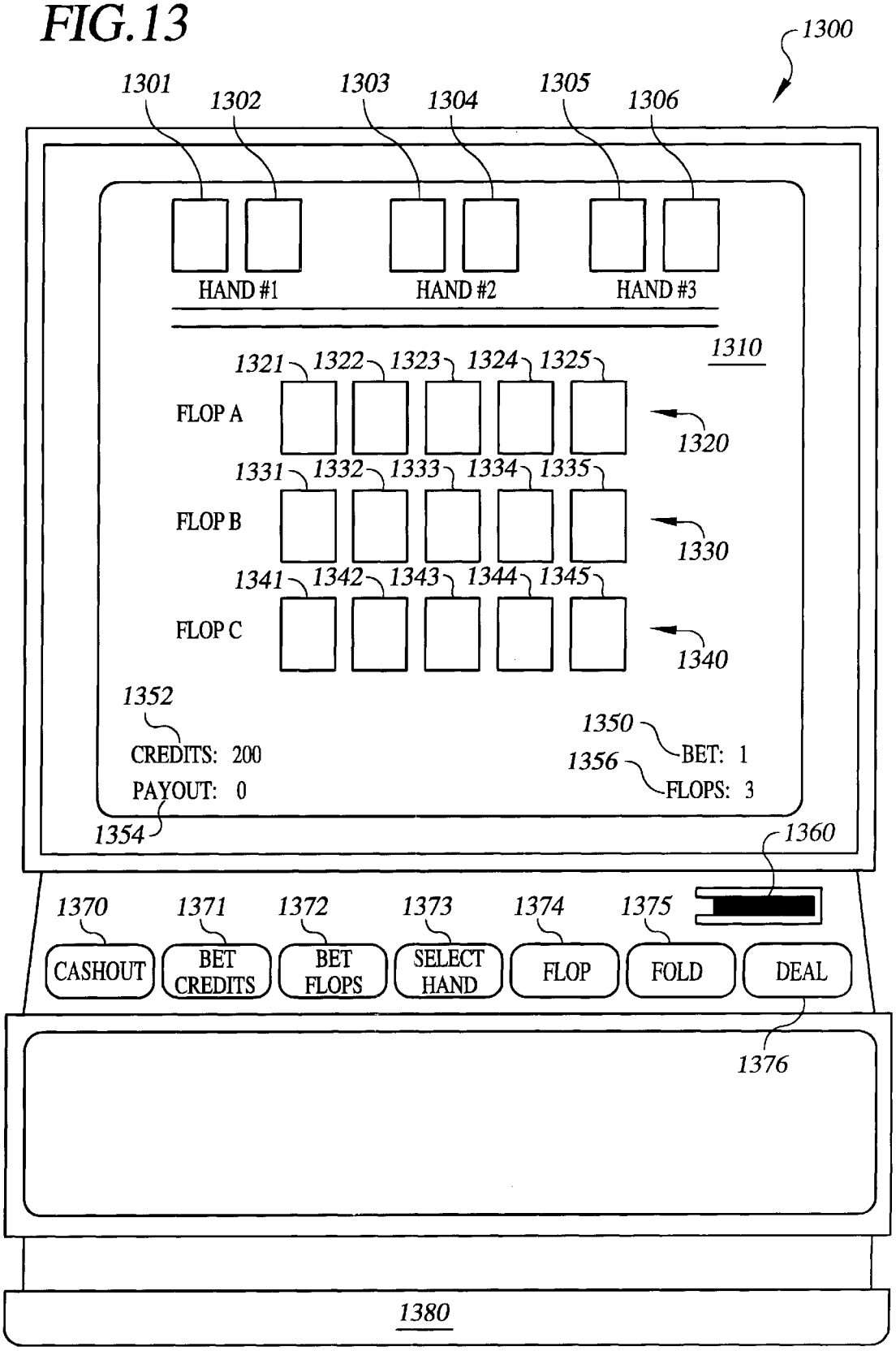
FIG. 13 illustrates an example electronic video poker device in which the principles of the present invention may be applied.

As depicted in FIG. 13, the electronic video poker device 1300 includes a display screen 1310 operative in a well known manner to display representations of conventional playing cards thereon. In accordance with the present invention, a central processing unit (CPU; not shown) of the device 1300 is instructed pursuant to one or more computing programs which may, for example, be stored in a read-only memory (ROM), programmable read-only memory (PROM) or other storage medium of the internal circuitry. The stored program code may be selectively determined, within the ambit of a programmer of ordinary skill in the art, having the benefit of the instant disclosure, to enable the electronic device 1300 to play the multi-play games of the present invention. A first portion of the display screen 1310 is operative to display, face-up, three two-card starting hands. HAND #1 includes screen card representations 1301, 1302; HAND #2 includes screen card representations 1303, 1304; and HAND #3 includes screen card representations 1305, 1306. In accordance with generally known technology in the field of video poker machines, the CPU of the device 1300, under appropriate program instruction, may accurately simulate the random dealing of each of the three hands from a shuffled conventional fifty-two card deck.

Another portion of the display screen 1310 is similarly operative to display the various flops associated with each concurrently-played hand. In the example of FIG. 13, each flop comprises five communal cards. Flop-A 1320 includes communal cards 1321, 1322, 1323, 1324 and 1325. Similarly, Flop-B 1330 includes communal cards 1331, 1332, 1333, 1334 and 1335, and Flop-C 1340 includes communal cards 1341, 1342, 1343, 1344 and 1345. Any desired number of flops, and thus concurrent hands, may be implemented, as previously described.

A display 1350 displays the value of the current bet, for example one token (where tokens may represent, for example, nickels, dimes, quarters, dollars, etc.) and similar displays 1352 and 1354 display the number of accumulated credits (i.e. tokens) and the number of tokens paid out, respectively. A display 1356 may be provided to display the number of flops, or concurrent hands, to play. For example, the participant may choose to play only two of the flops 1320, 1330, which may require two credits. Alternatively, the participant may choose to play three flops 1320, 1330, 1340, which will generally require a proportionally higher quantity of credits, such as three credits. Another embodiment involves a predefined number of flops that is not selectable by the participant. For example, the video poker device 1300 may be configured to always provide three flops, thereby eliminating the need for participant selection and the display 1356.

A token acceptor 1360 is operative to receive wager tokens, or alternatively, coins, bills, credit/debit cards, coupons, smart cards, prepaid casino cards, and the like. Various control buttons 1370, 1371, 1372, 1373, 1374, 1375 and 1376 allow the player to make control inputs during play of the game of the present invention. In an example manner of play of the electronic video poker device 1300, a player first enters tokens or coins into the acceptor 1360 to acquire a credit balance on credit display 1352. If desired, the player may alternatively place each bet individually after each hand by inserting coins, tokens, bills, etc. The player then pushes the BET CREDITS button 1371 one or more times to place, a wager which is displayed by bet display 1350.

The electronic device 1300 may be programmed to limit the number of tokens that can be bet on a single hand. Such a limit is dependent on a predetermined limit of credits per flop, as well as the number of concurrent hands that will be played. For example, where a predetermined limit of five credits are allowed to be bet on a single hand, and where there are three flops, up to five credits per flop will be allowed. In an embodiment that allows the participant to select the number of concurrent hands to play, the BET FLOPS button 1372 may be pressed to indicate the desired number of hands for concurrent play. For example, pressing the BET FLOPS button 1372 twice would allow two concurrent hands to be played by way of flop-A 1320 and flop-B 1330. Pressing the BET FLOPS button 1372 three times would allow three hands to be concurrently played, and so forth. The number of selected flops to be played can be displayed at the flop display 1356. Various user interface options could be used in place of a button such as the BET FLOPS button 1372, such as a touch screen or other interactive selection of the number of concurrent hands to play. Alternatively, in an embodiment disallowing the participant to select the number of concurrent hands to play, no BET FLOPS 1372 button or other such user interface would be required.

After the player is satisfied with the amount bet, the player pushes the DEAL button 1376, which causes the device 1300 to "deal" face-up the two-card starting hands, which in the illustrated embodiment includes three starting hands HAND #1, HAND #2, and HAND #3. The player pushes the SELECT HAND button 1373 one or more times to select one of the starting hands. A suitable visual indication of the hand selected is preferably provided. For example, the HAND #1 indicia may be illuminated if the player selects that starting hand. After the player is satisfied with the selected starting hand, the player pushes the FLOP button 1374, causing the device 1300 to "deal" all of the communal cards face-up for the multiple flops, such as flop-A 1320, flop-B 1330 and flop-C 1340. In one embodiment of the invention, all of the cards associated with each flop will be revealed. In other embodiments, described more fully below, a predetermined subset of each of the flops is revealed while leaving one or more cards face down. Leaving one or more cards face down provides an opportunity for additional bets prior to revealing the entire resulting hand, and/or may afford the participant an opportunity to surrender a portion of his or her bet and fold by depressing the FOLD button 1375. Where additional bets are placed after a predetermined number of the cards associated with each of the flops have been revealed, or when the participant has decided not to forfeit a portion of the bet and fold, the player may continue the hand by again depressing the FLOP button 1374, causing the device to deal remaining communal cards of the flops face-up. The device 1300 may be programmed to suitably prompt the player for required control inputs during the course of play. For example, one or more of the control buttons may flash when activation of such buttons is a current player option or input requirement. The device 1300 automatically compares the three hands associated with each flop 1320, 1330, 1340, and determines whether the player selected the winning hand for each of the flops. For each of the concurrently played hands, the device 1300 makes an appropriate electronic or physical settlement of the wagers. Paid out coins or tokens may be dispensed into tray 1380 for collection or storage by the player. When a player wishes to cease play, any accumulated credits may be refunded by depressing the CASHOUT button 1370.

As may now be readily understood, the device 1300 may be programmed to play various embodiments of the invention. Alternatively, the device may include a control input to allow a player to select play of different variations of the game. In connection with certain embodiments of the invention, the device 1300 may be programmed to make appropriate bonus payouts in accordance with the odds set forth in Table 2 below.

TABLE 2

Payoff Odds

| Poker Rank of Winning Hand | Payoff Odds |
|---|---|
| Royal Flush | 50 to 1 |
| Straight Flush | 20 to 1 |
| Four Of A Kind | 8 to 1 |
| Full House | 3 to 1 |
| Flush | 2 to 1 |
| All Other | 1 to 1 |

Figure 14:
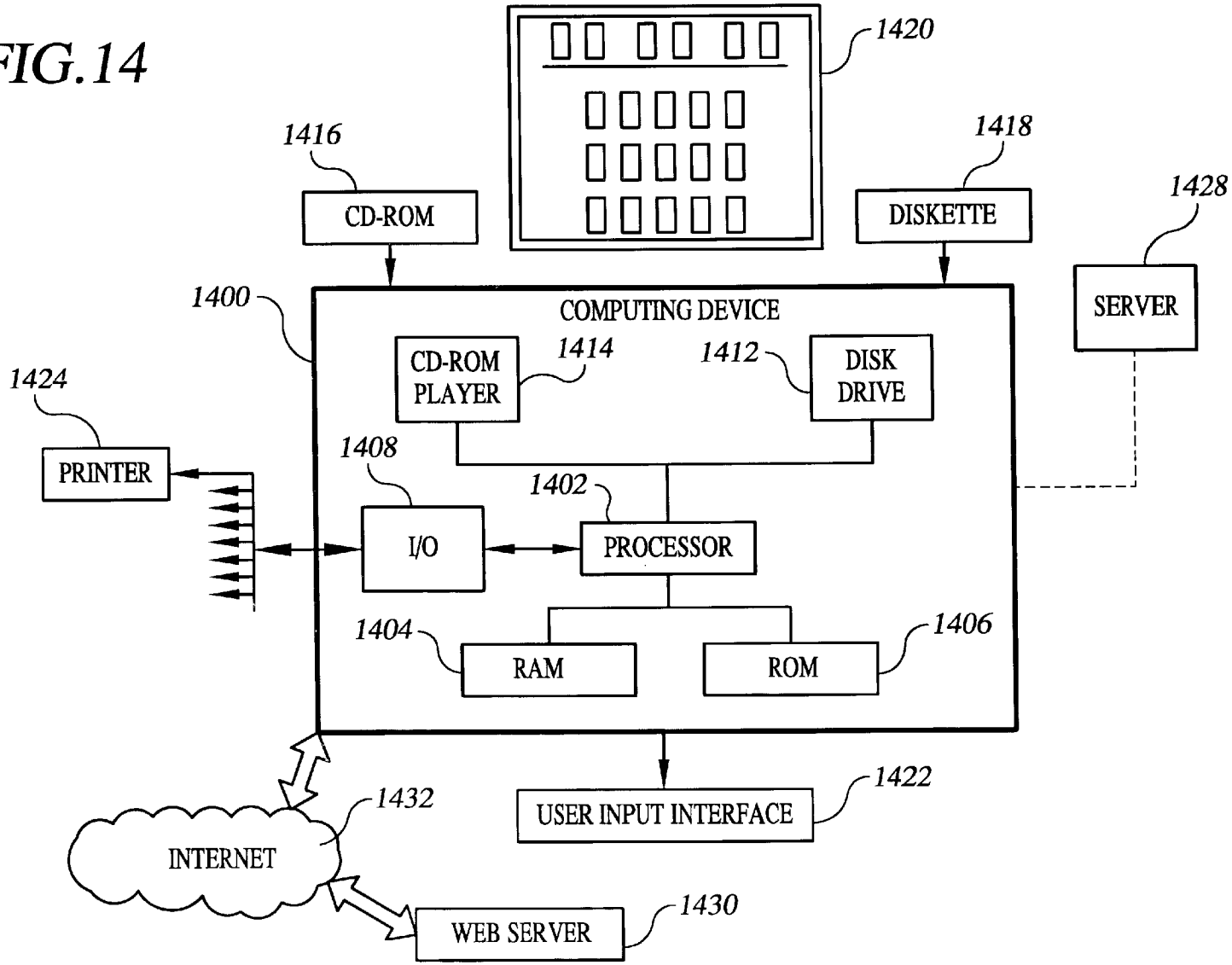
FIG. 14 generally illustrates a block diagram of an example computing system that may be used in connection with an electronic video poker device or other computing device capable of executing computer programs to carry out operations in accordance with the present invention.

The electronic video poker device described in connection with FIG. 13 includes a computing system to control the functions and operations of the invention. FIG. 14 generally illustrates a block diagram of an example computing system that may be used in connection with an electronic video poker device as described in connection with FIG. 13, or other computing devices capable of executing computer programs to carry out the inventive operations. Hardware, firmware, software or a combination thereof may be used to perform the various operations described above. The functional modules used in connection with the invention may reside in a video poker device as described, or may reside on a stand-alone or networked computer. An example computing structure that can be used in connection with such electronic video poker devices, computers, or other computer-implemented devices to carry out operations of the present invention is illustrated in FIG. 14.

Referring now to FIG. 14, a system block diagram of a example computing system 1400 is shown, in which the principles of the present invention may be applied. A computing arrangement suitable for performing the multi-play poker functions in accordance with the present invention typically includes a central processor (CPU) 1402 coupled to random access memory (RAM) 1404 and read-only memory (ROM) 1406. The processor 1402 may communicate with other internal and external components through input/output (I/O) circuitry 1408 and bussing 1410. The computing arrangement 1400 may also include one or more data storage devices, including hard and floppy disk drives 1412, CD-ROM drives 1414, and other hardware capable of reading and/or storing information. In one embodiment, software for carrying out the multi-play poker games in accordance with the present invention may be stored and distributed on a CD-ROM 1416, diskette 1418 or other forms of media capable of portably storing information. These storage media may be inserted into, and read by, devices such as the CD-ROM drive 1414, the disk drive 1412, etc. The software may also be transmitted to the computing arrangement 1400 via data signals, such as being downloaded electronically via a network, such as the Internet. The computing arrangement 1400 may also include a display 1420. Where the computing device 1400 represents a stand-alone or networked computer, the display 1420 represents a standard computer terminal or display. Where the computing device is embedded within an electronic video poker device, such as device 1300 of FIG. 13, the display 1420 corresponds to the display screen 1310 of FIG. 13. A user input interface 1422 such as a mouse or keyboard may be provided where the computing device 1400 is associated with a standard computer. An embodiment of a user input interface 1422 is illustrated in connection with an electronic video poker device 1300 of FIG. 13 as the various "buttons, " such as buttons 1370, 1371, 1372, 1373, 1374, 1375 and 1376. Optionally, a printer 1424 may be provided to print screen images, statistics, results, and the like.

The computing arrangement 1400 may optionally be connected to other computing devices, such as on a network, particularly in connection with a computer implementation versus an electronic video poker implementation. The computing arrangement 1400 may be connected to a network server 1428 in an intranet or local network configuration. The computer may further be part of a larger network configuration as in a global area network (GAN) such as the Internet. In such a case, the computer accesses one or more web servers 1430 via the Internet 1432. Such a networked embodiment may be particularly useful where two or more players collectively participate in the game via a network connection. In such a case, actual participants may take the place of one or more of the virtual players, thereby allowing a variable number of actual players and virtual players. The networked configuration is also beneficial where the software associated with the invention is stored on a server system (e.g., server 1428, 1430), and is accessed by the computing device 1400 in a client-server arrangement.

Using the foregoing specification, the invention may be implemented as a machine, process, or article of manufacture by using standard programming and/or engineering techniques to produce programming software, firmware, hardware or any combination thereof.

Any resulting program(s), having computer-readable program code, may be embodied within one or more computer-usable media such as memory devices or transmitting devices, thereby making a computer program product or article of manufacture according to the invention. As such, the terms "article of manufacture" and "computer program product" as used herein are intended to encompass a computer program existent (permanently, temporarily, or transitorily) on any computer-usable medium such as on any memory device or in any transmitting device.

One skilled in the art of computer science from the description provided herein will be able to combine the software created as described with appropriate general purpose or special purpose computer hardware to create a computer system and/or computer subcomponents embodying the invention, and to create a computer system and/or computer subcomponents for carrying out the method of the invention.

The present invention may be implemented in live table versions. An example table layout 1500 is illustrated in FIG. 15 for use as a gaming table cover or top surface in playing live casino versions of the poker game in accordance with the invention.

Figure 15:
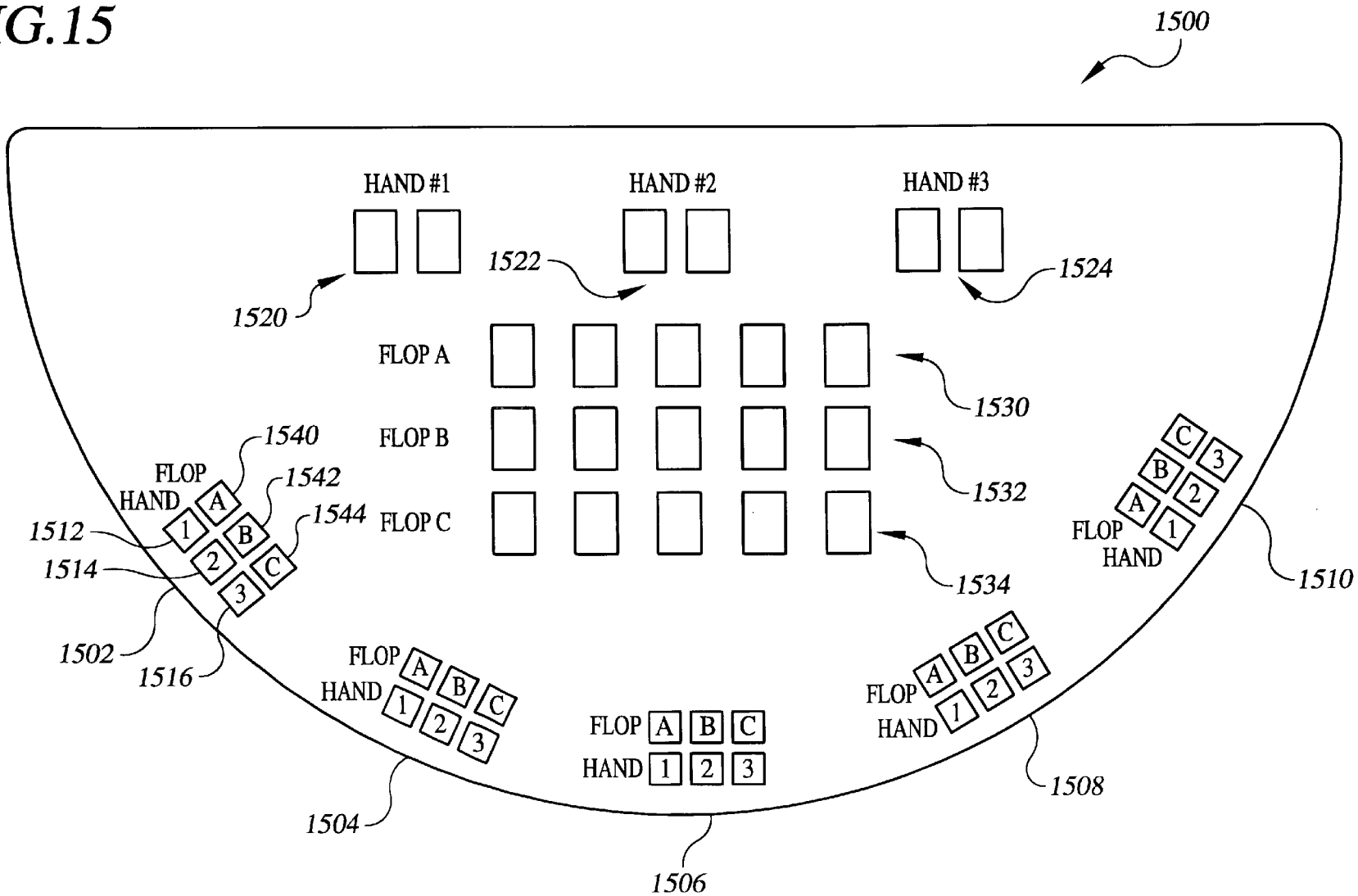
FIG. 15 represents an example table layout for use as a gaming table cover or top surface in playing live casino versions of the poker game in accordance with the invention.

The embodiment of FIG. 15 includes a plurality of player locations 1502, 1504, 1506, 1508, 1510 spaced around an arcuate peripheral edge at which one or more players will sit or stand during play of the game. The dealer faces the players, behind the straight edge of the layout 1500. The layout 1500 may be formed from a felt material in a manner known in the art, for example, in connection with conventional Twenty-One table layouts. Alternatively, the layout may be physically incorporated into the surface of a gaming table. Each of the player locations, for example, player location 1502, includes three sequentially numbered hand selection indicia 1512, 1514, 1516. By placing a marker, such as a chip or other token, upon one of the three selection indicia 1512, 1514, 1516, a player may select one of available two-card starting hands dealt during play by a dealer into designated hand locations HAND #1 1520, 1522, 1524, each consisting of indicia on the layout 1500 to which the various starting hands will be dealt. The selection indicia 1512, 1514, 1516 may be printed, electrically lit via switch buttons, and the like. In the case of electrically lit selection indicia, illumination of an electric light, LED, or the like provides a positive visual indication of each player's selected hand. Such illuminated indicia preferably includes suitable logic circuitry to enable players to change their initial selection by pushing a different button until such time as the dealer activates a lock-out switch preventing further changes in hand selection. Such logic circuitry may also provide for prompting of player hand selection input at the appropriate time. Prompting may take the form of blinking indicia, or other visual or audible signal. The use of electronic selection indicia prevents potential disputes which might arise using manual manipulation of a marker by each player to select one of the three hands, as the marker is susceptible of inadvertent or intentional displacement after initial positioning.

Each of the player locations may also include betting boxes for each of the multiple flops that will be dealt. For example, in the embodiment where three flops will be played (i.e., FLOP-A 1530, FLOP-B 1532, FLOP-C 1534) flop bet boxes 1540, 1542 and 1544 are provided at each player location. In this embodiment, the player can make individual bets on each of the multiple flops, as flop bet box 1540 corresponds to FLOP-A 1530, flop bet box 1542 corresponds to FLOP-B 1542, and flop bet box 1544 corresponds to FLOP-C 1534. Alternatively, a single bet box can be provided, and a the bet is divided equally among the number of concurrent flops that are to be played.

Figure 16:
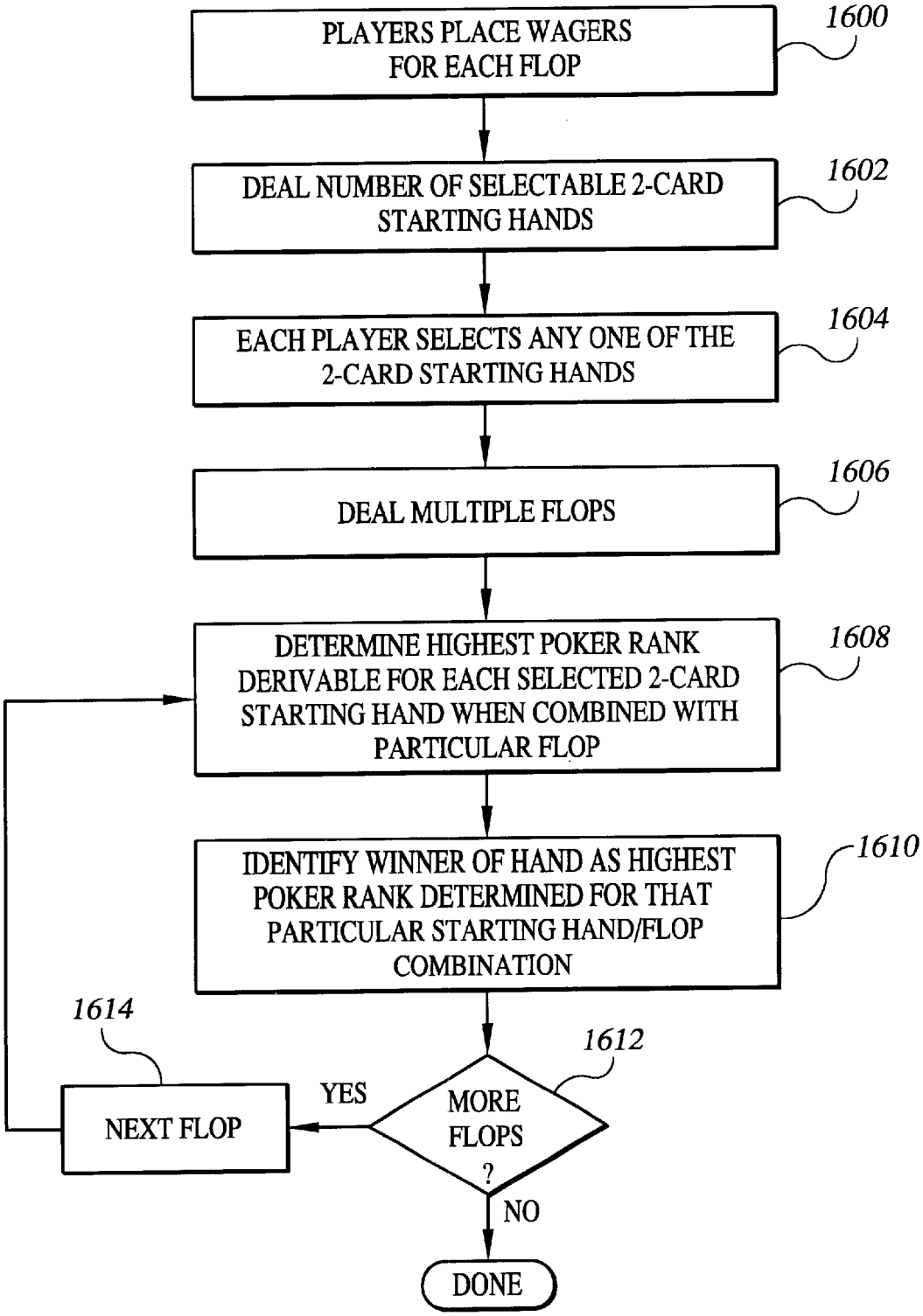
FIG. 16 is a flow diagram illustrating a manner of playing a live casino version of the poker game in accordance with the present invention.

The live table layout 1500 facilitates live play in accordance with the present invention as described above. One particular embodiment of a manner of playing a poker game in accordance with the present invention in a live table format is illustrated in the flow diagram of FIG. 16. Each of the players at the table places the desired wagers for each of the concurrent hands that will be played, as illustrated at operation 1600. In this particular embodiment, the player may select how many multiple hands to concurrently play. For example, and referring briefly to FIG. 15, the player at player location 1502 may place wagers on FLOP-A 1530 and FLOP-B 1532 via flop bet boxes 1540 and 1542, or alternatively may place wagers on all three flops 1530, 1532, 1534 by also placing a wager via flop bet box 1544. Alternatively, a house or table rule may require each player to concurrently play all multiple flops.

A number of selectable two-card starting hands are dealt 1602, and each of the players associated with the live poker game selects 1604 any one of the two-card starting hands. In this embodiment, any one or more of the players may select the same starting hand. For example, again briefly referring to FIG. 15, the players at player locations 1502, 1504 and 1506 could all identify their selection of starting hands as HAND #1 1520. These players will then win or lose together. If the resulting hands of each of these players results in a winning hand against any players selecting non-winning starting hands, it can result in a win for each player, or a "push, " depending on the particular house or table rules.

Once each player has selected the desired starting hand, multiple flops are dealt 1606. The highest poker rank derivable for each selected two-card starting hand and a first of the multiple flops is determined 1608, and the winner(s) is identified 1610 as the highest poker rank(s) for that flop. A winner(s) for each flop is determined, as illustrated at decision operation 1612, where the next flop 1614 is similarly analyzed, and so forth until a winner for each of the multiple flops has been identified. Bets are settled according to the winner(s) of each flop.

The invention has been described in its presently contemplated best mode, and it is clear that it is susceptible to various modifications, modes of operation and embodiments, all within the ability and skill of those skilled in the art and without the exercise of further inventive activity. Accordingly, what is intended to be protected by Letters Patents is set forth in the appended claims.

What is claimed is:

1. A method for electronically facilitating concurrent play of multiple, communal-card poker games by a participant, comprising:

displaying a plurality of selectable starting hands of cards on a display device, wherein each of the selectable starting hands represents a potential subset of a resulting poker hand;

allowing the participant to select one of the plurality of selectable starting hands via a user interface;

displaying a plurality of multi-card flops on the display device, wherein each of the multi-card flops displayed corresponds to one of the concurrently-played poker games;

deriving a plurality of participant resulting poker hands, one for each combination of the participant's selected starting hand and the plurality of multi-card flops;

deriving a plurality of remaining resulting poker hands, one for each combination of non-selected ones of the starting hands and the plurality of multi-card flops; and comparing the participant resulting poker hands to the remaining resulting poker hands on a per-poker game basis, such that the participant resulting poker hands and the remaining resulting poker hands associated with corresponding multi-card flops are compared.

2. The method of claim 1, wherein displaying a plurality of selectable starting hands comprises displaying, face up, two cards for each of the selectable starting hands.

3. The method of claim 1, wherein allowing the participant to select one of the selectable starting hands comprises presenting a user interface by which the participant identifies the selected starting hand.

4. The method of claim 3, wherein presenting a user interface comprises presenting a graphical user interface by which the participant identifies the selected starting hand using selector images on the display device.

5. The method of claim 3, wherein presenting a user interface comprises presenting an audio user interface by which the participant identifies the selected starting hand using audible commands.

6. The method of claim 3, wherein presenting a user interface comprises presenting a mechanical user interface by which the participant identifies the selected starting hand via activation of a dedicated selection key.

7. The method of claim 1, wherein displaying a plurality of multi-card flops on the display device comprises displaying, face up, five communal cards for each of the multi-card flops.

8. The method of claim 1, wherein deriving a plurality of participant resulting poker hands comprises determining a poker rank associated with each of the plurality of the participant resulting poker hands.

9. The method of claim 1, wherein deriving a plurality of remaining resulting poker hands comprises determining a poker rank associated with each of the plurality of the remaining resulting poker hands.

10. The method of claim 1, wherein:

deriving a plurality of participant resulting poker hands comprises determining a poker rank associated with each of the plurality of the participant resulting poker hands;

deriving a plurality of remaining resulting poker hands comprises determining a poker rank associated with each of the plurality of the remaining resulting poker hands; and comparing the participant resulting poker hands to the remaining resulting poker hands on a per-poker game basis comprises comparing the poker rank associated with the plurality of the participant resulting poker hands to the poker rank associated with the plurality of the remaining resulting poker hands on a per poker-game basis.

11. The method of claim 10, further comprising identifying the participant as a poker game winner for each of the concurrently-played poker games in which the participant's poker rank is greater than or equal to the remaining resulting poker hands.

12. A method for electronically facilitating concurrent play of multiple, communal-card poker games by a participant, comprising:

displaying a plurality of selectable starting hands of cards on a display device, wherein each of the selectable starting hands represents a potential subset of a resulting poker hand;

allowing the participant to select one of the plurality of selectable starting hands via a user interface;

displaying a plurality of multi-card flops on the display device, wherein each of the multi-card flops displayed corresponds to one of the concurrently-played poker games;

deriving a plurality of participant resulting poker hands, one for each combination of the participant's selected starting hand and each of the multi-card flops, wherein each of the participant's resulting poker hands is derived by determining the highest poker rank available for a predetermined number of total cards associated with each combination of the participant's selected starting hand and each of the multi-card flops;

deriving a plurality of remaining resulting poker hands, one for each combination of non-selected ones of the starting hands and each of the multi-card flops, wherein each of the remaining resulting poker hands is derived by determining the highest poker rank available for the predetermined number of total cards associated with each combination of the non-selected starting hands and each of the multi-card flops; and comparing the participant's resulting poker hands to the remaining resulting poker hands for each of the concurrently-played poker games to determine whether the participant's resulting poker hands have a higher poker rank than corresponding ones of the remaining resulting poker hands for each of the concurrently-played poker games.

13. The method of claim 12, wherein determining the highest poker rank available for the predetermined number of total cards associated with each combination of the participant's selected starting hand and each of the multi-card flops comprises identifying a permutation of the predetermined number of total cards associated with each combination of the participant's selected starting hand and each of the multi-card flops that is accorded the highest rank in a predetermined hierarchical poker rank.

14. The method of claim 12, wherein determining the highest poker rank available for the predetermined number of total cards associated with each combination of the non-selected starting hands and each of the multi-card flops comprises identifying a permutation of the predetermined number of total cards associated with each combination of the non-selected starting hands and each of the multi-card flops that is accorded the highest rank in a predetermined hierarchical poker rank.

15. The method of claim 12, wherein:

(a) determining the highest poker rank available for the predetermined number of total cards associated with each combination of the participant's selected starting hand and each of the multi-card flops comprises identifying a permutation of the predetermined number of total cards associated with each combination of the participant's selected starting hand and each of the multi-card flops that is accorded the highest rank in a predetermined hierarchical poker rank;

(b) determining the highest poker rank available for the predetermined number of total cards associated with each combination of the non-selected starting hands and each of the multi-card flops comprises identifying a permutation of the predetermined number of total cards associated with each combination of the non-selected starting hands and each of the multi-card flops that is accorded the highest rank in a predetermined hierarchical poker rank; and (c) comparing the participant's resulting poker hands to the remaining resulting poker hands for each of the concurrently-played poker games comprises comparing corresponding permutations accorded the highest ranks for each combination of the participant's selected starting hand and each of the multi-card flops and for each combination of the non-selected starting hands and each of the multi-card flops.

16. The method of claim 12, further comprising identifying the participant as a winner of the concurrently-played poker games in which the participant's resulting poker hands have a higher poker rank than corresponding ones of the remaining resulting poker hands for corresponding concurrently-played poker games.

17. The method of claim 16, further comprising placing a wager for each of the concurrently-played poker games.

18. The method of claim 17, further comprising providing a payout to the participant for each of the concurrently-played poker games in which the participant was identified as the winner.

19. The method of claim 12, further comprising placing a wager for at least one of the concurrently-played poker games.

20. The method of claim 19, further comprising providing a payout to the participant for each of the concurrently-played poker games in which the participant's resulting poker hands have a higher poker rank than corresponding ones of the remaining resulting poker hands.

21. The method of claim 20, wherein the payout is proportional to the wager placed for each of the concurrently-played poker games.

22. The method of claim 20, wherein the payout is provided in the form of currency.

23. The method of claim 20, wherein the payout is provided in the form of credits available for use as additional wagers.

24. The method of claim 20, wherein the payout is provided in the form of credits which can be converted to currency.

25. The method of claim 20, wherein providing a payout further comprises providing bonus payouts to the participant for each of the concurrently-played poker games in which the participant's resulting poker hand attains predetermined poker rank levels; wherein each bonus payout quantity depends on which of the predetermined poker rank levels was attained.

26. The method of claim 12, further comprising turning face-up a subset of each of the multi-card flops, wherein the subset comprises less than all cards associated with each of the multi-card flops.

27. The method of claim 26, further comprising allowing a wager to be placed for each of the concurrently-played poker games after the subset of each of the multi-card flops has been turned face-up.

28. The method of claim 27, further comprising allowing the participant to discontinue play of one or more of the concurrently-played poker games after the subset of each of the multi-card flops has been turned face-up and, as a result, to forfeit at least a portion of the wagers placed for the respective one or more of the concurrently-played poker games.

29. The method of claim 27, further comprising repeatedly turning face-up an additional one or more cards associated with each of the multi-card flops, and allowing either a wager to be placed or play to be terminated for any one or more of the concurrently-played poker games after the additional one or more cards is turned face-up, until all of the cards associated with the multi-card flops have been turned face-up.

30. The method of claim 12, further comprising identifying a number of concurrent poker games to play via the user interface.

31. The method of claim 12, further comprising providing each of the multi-card flops from separate virtual decks of cards.

32. The method of claim 12, further comprising providing each of the multi-card flops from a single virtual deck of cards.

33. The method of claim 12, further comprising providing each of the multi-card flops from an aggregation of a predetermined number of virtual decks of cards.

34. A method for a plurality of players to concurrently play multiple communal-card poker rounds, comprising:

(a) presenting a plurality of starting hands face-up, wherein each starting hand includes one or more cards representing a potential portion of a resulting poker hand;

(b) requiring each player to select any one of the starting hands;

(c) presenting a plurality of communal-card flops face-up, wherein one of the communal-card flops is presented for each of the multiple poker rounds that is concurrently played;

(d) for a first of the concurrently-played poker rounds, comparing the players' resulting poker hands, each derived from each player's selected starting hand and a first of the communal-card flops, wherein a predetermined poker rank is used as a criterion for comparison; and (e) for a second of the concurrently-played poker rounds, comparing the players' resulting poker hands, each derived from each player's selected starting hand and a second of the communal-card flops, wherein the predetermined poker rank is used as the criterion for comparison.

35. The method of claim 34, further comprising, for an n-th of the concurrently-played poker rounds, comparing the players' resulting poker hands, each derived from each player's selected starting hand and an n-th of the communal-card flops, wherein the predetermined poker rank is used as the criterion for comparison, and wherein n is greater than or equal to three.

36. A method for concurrently playing multiple communal-card poker games, comprising:

presenting a plurality of selectable starting hands of cards, wherein each of the selectable starting hands represents a potential subset of a resulting poker hand;

allowing game participants to select any one of the plurality of selectable starting hands;

presenting a plurality of communal-card flops, wherein each of the presented communal-card flops corresponds to one concurrently-played communal-card poker game;

deriving resulting poker hands for each of the concurrently-played communal-card poker games for each of the participants, wherein each of the resulting poker hands is derived from at least a portion of the cards associated with each selected starting hand and one of the communal-card flops; and comparing each of the participants' resulting poker hands to each other on a per-poker game basis.

37. The method of claim 36, wherein one or more of the game participants are electronically-generated virtual participants.

38. The method of claim 37, wherein allowing game participants to select any one of the plurality of selectable starting hands comprises allowing actual participants to select any one of the selectable starting hands, and assigning remaining ones of the selectable starting hands to the electronically-generated virtual participants.

39. The method of claim 37, wherein each of the electronically-generated virtual participants is represented by the resulting poker hands not associated with actual game participant's resulting poker hands.

40. The method of claim 36, wherein deriving resulting poker hands comprises identifying a highest poker rank associated with each of the resulting poker hands.

41. The method of claim 40, wherein identifying the highest poker rank associated with each of the resulting poker hands comprises identifying a permutation of the cards associated with the selected starting hand and a respective communal-card flop that is accorded the highest rank in a predetermined hierarchical poker rank.

42. The method of claim 36, further comprising identifying a winning participant for each of the concurrently-played poker games as the game participant having the highest poker rank for that concurrently-played poker game.

43. The method of claim 36, wherein allowing game participants to select any one of the plurality of selectable starting hands comprises allowing a plurality of the participants to select a same one of the selectable starting hands.

44. A method for concurrently playing multiple poker rounds, comprising:

dealing a plurality of starting hands, wherein each starting hand includes one or more cards representing a potential portion of a resulting poker hand;

selecting one of the starting hands by a game participant for use in all of the multiple poker rounds;

distributing remaining starting hands to a corresponding number of dummy hands for use in all of the multiple poker rounds;

dealing a plurality of communal card flops, wherein each of the communal card flops includes at least one face up card, and wherein the number of communal card flops dealt corresponds to the number of multiple poker rounds being concurrently played;

determining participant poker ranks for each of the game participant's resulting poker hands derived from cards comprising the selected starting hand and each of the plurality of the communal card flops;

determining remaining poker ranks for each resulting dummy hand derived from cards comprising each remaining starting hand and each of the plurality of the communal card flops; and for each of the multiple poker rounds concurrently played, determining which of the participant's resulting poker hands and the dummy hands corresponds to a winning poker hand in accordance with a predetermined poker rank hierarchy.

45. The method of claim 44, wherein any number of the cards in the selected starting hand, including zero cards, is used in formulating the game participant's resulting poker hands.

46. The method of claim 44, wherein any number of the cards in the remaining starting hands, including zero cards, is used in formulating respective ones of the resulting dummy hands.

47. A computer-implemented poker apparatus for allowing a game participant to concurrently play a plurality of communal-card poker rounds, the poker apparatus comprising:

a display device to display an electronic image of a plurality of starting hands and a plurality of communal-card flops, wherein the number of the communal-card flops dealt corresponds to the number of concurrently played communal-card poker rounds, and wherein the starting hands represent a potential portion of a resulting poker hand;

a user interface to allow the game participant to select one of the displayed starting hands; and a computer processing system configured to derive a plurality of participant's resulting poker hands from corresponding card groups comprising the selected starting hand and each of the plurality of communal-card flops, to derive remaining resulting poker hands from corresponding card groups comprising each non-selected starting hand in connection with each of the plurality of communal-card flops, and to determine relative poker ranks of the participant's resulting poker hand and the remaining resulting poker hands for each corresponding poker round.

48. The computer-implemented poker apparatus as in claim 47, further comprising a video poker housing to collectively accommodate the display device, the user interface, and the computer processing system, whereby the computer-implemented poker apparatus is presented as a self-contained video poker machine.

49. A computer-implemented poker apparatus for allowing a game participant to concurrently play a plurality of communal-card poker games, the poker apparatus comprising:

means for displaying a plurality of selectable starting hands of cards, wherein each of the selectable starting hands represents a potential subset of a resulting poker hand;

means for allowing the participant to select one of the plurality of selectable starting hands;

means for displaying a plurality of multi-card flops, wherein each of the multi-card flops displayed corresponds to one of the concurrently-played poker games;

means for deriving a plurality of participant resulting poker hands, one for each combination of the participant's selected starting hand and the plurality of multi-card flops;

means for deriving a plurality of remaining resulting poker hands, one for each combination of non-selected ones of the starting hands and the plurality of multi-card flops; and means for comparing the participant resulting poker hands to the remaining resulting poker hands on a per-poker game basis, such that the participant resulting poker hands and the remaining resulting poker hands associated with corresponding multi-card flops are compared.

50. The computer-implemented poker apparatus as in claim 49, wherein the means for deriving a plurality of participant resulting poker hands comprises means for determining a highest poker rank available for a predetermined number of total cards associated with each combination of the participant's selected starting hand and each of the multi-card flops.

51. The computer-implemented poker apparatus as in claim 49, further comprising means for placing a wager for each of the concurrently-played poker games.

52. The computer-implemented poker apparatus as in claim 49, further comprising means for providing a payout to the participant for each of the concurrently-played poker games in which the participant resulting poker hands have a poker rank greater than or equal to corresponding ones of the remaining resulting poker hands.

53. The computer-implemented poker apparatus as in claim 49, further comprising means for providing a payout to the participant for each of the concurrently-played poker games in which the participant resulting poker hands have a poker rank greater than corresponding ones of the remaining resulting poker hands.

54. A computer-readable medium having instructions stored thereon which are executable by a computer system for electronically facilitating concurrent play of multiple communal-card poker games by a participant by performing steps comprising:

displaying a plurality of selectable starting hands of cards on a display device, wherein each of the selectable starting hands represents a potential subset of a resulting poker hand;

allowing the participant to select one of the plurality of selectable starting hands via a user interface;

displaying a plurality of multi-card flops on the display device, wherein each of the multi-card flops displayed corresponds to one of a plurality of concurrently-played poker games;

deriving a plurality of participant resulting poker hands, one for each combination of the participant's selected starting hand and the plurality of multi-card flops;

deriving a plurality of remaining resulting poker hands, one for each combination of non-selected ones of the starting hands and the plurality of multi-card flops; and comparing the participant resulting poker hands to the remaining resulting poker hands on a per-poker game basis, such that tie participant resulting poker hands and the remaining resulting poker hands associated with corresponding multi-card flops are compared.

* * * * *

UNITED STATES PATENT AND TRADEMARK OFFICE

CERTIFICATE OF CORRECTION

PATENT NO. : 6,511,068 B1
DATED : January 28, 2003
INVENTOR(S) : Sklansky et al.

It is certified that error appears in the above-identified patent and that said Letters Patent is hereby corrected as shown below:

Title page,
Item [73], Assignee, "Sklansky LLC" should read -- Sklansky Games LLC --.

Signed and Sealed this

Twelfth Day of August, 2003

JAMES E. ROGAN
*Director of the United States Patent and Trademark Office*